US009927772B2

(12) United States Patent
Stranczl et al.

(10) Patent No.: US 9,927,772 B2
(45) **Date of Patent: *Mar. 27, 2018**

(54) FLEXIBLE CONSTANT-FORCE PALLET LEVER

(71) Applicant: Nivarox-FAR S.A., Le Locle (CH)

(72) Inventors: Marc Stranczl, Nyon (CH); Jean-Luc Helfer, Le Landeron (CH)

(73) Assignee: Nivarox-FAR S.A., Le Locle (CH)

( * ) Notice: Subject to any disclaimer, the term of this patent is extended or adjusted under 35 U.S.C. 154(b) by 0 days.

This patent is subject to a terminal disclaimer.

(21) Appl. No.: 15/409,037

(22) Filed: Jan. 18, 2017

(65) Prior Publication Data

US 2017/0131683 A1 May 11, 2017

Related U.S. Application Data

(62) Division of application No. 14/426,616, filed as application No. PCT/EP2013/068130 on Sep. 3, 2013, now Pat. No. 9,594,349.

(30) Foreign Application Priority Data

Sep. 7, 2012 (EP) ..... 12183559

(51) Int. Cl.
*G04B 15/08* (2006.01)
*G04B 15/14* (2006.01)

(52) U.S. Cl.
CPC ..... *G04B 15/08* (2013.01); *G04B 15/14* (2013.01)

(58) Field of Classification Search
CPC ..... G04B 15/08
See application file for complete search history.

(56) References Cited

U.S. PATENT DOCUMENTS 2,864,232 A * 12/1958 Tuetey ..... G04B 15/14 368/132
9,201,398 B2 12/2015 Cusin ..... G04B 13/025
2011/0019506 A1 1/2011 Dehon
(Continued)

FOREIGN PATENT DOCUMENTS

EP 2 105 806 9/2009
EP 2 444 860 4/2012
(Continued)

OTHER PUBLICATIONS

International Search Report dated Feb. 5, 2014 in PCT/EP13/068130 filed Sep. 3, 2013.

*Primary Examiner* — Edwin A. Leon
*Assistant Examiner* — Jason Collins
(74) *Attorney, Agent, or Firm* — Oblon, McClelland, Maier & Neustadt, L.L.P.

(57) ABSTRACT

Pallet lever (1) including a head (2) arranged to cooperate with an escape wheel (20) and a fork (6) arranged to cooperate with a balance (30).
The angular position of said fork (6) is variable relative to said head (2).
A flexible strip (10) provides the only permanent, mechanical connection between said head (2) and said fork (6).
Escapement mechanism (100) including a plate (40), an escape wheel (20) and a balance (30), cooperating with said pallet lever (1).
Said flexible strip (10) is mounted prestressed buckled between said head (2) and said fork (6), said pallet lever (1) forming a bistable system comprising at least two stable states and two metastable states.

19 Claims, 17 Drawing Sheets

(56) References Cited

U.S. PATENT DOCUMENTS

| | | | | |
|---|---|---|---|---|
| 2013/0070570 | A1 | 3/2013 | Colpo | G04B 15/06<br>368/127 |
| 2013/0176830 | A1 | 7/2013 | Ferrara | |

FOREIGN PATENT DOCUMENTS

| | | |
|---|---|---|
| FR | 2 928 015 | 8/2009 |
| WO | WO 2011 064682 | 6/2011 |

* cited by examiner 1
10
2
200
80
81
20
3,4
6
30

10
80
81
20
1
30

1
9
40
10
5
40

40
46
9
40
1
10
5
40

T17
T1
T2
T3
T4
T5
T6
T7
T8
D
0
Y
T9
T10
T11
R
X
T12
T13
T14
T15
T16

Fig. 30
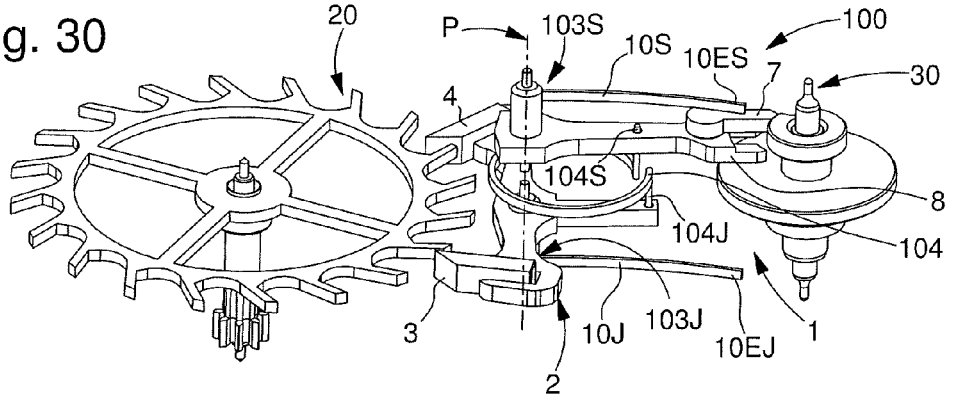
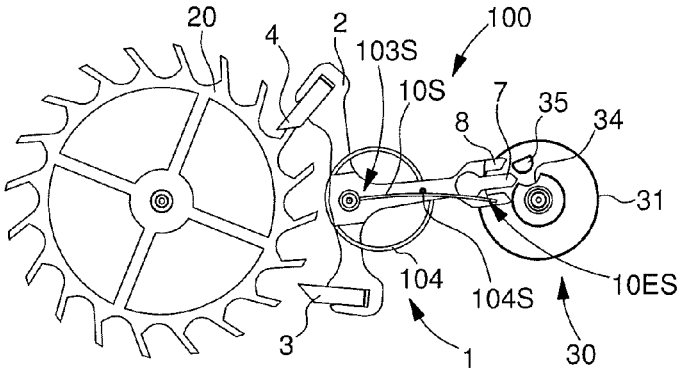
Fig. 31
Fig. 32
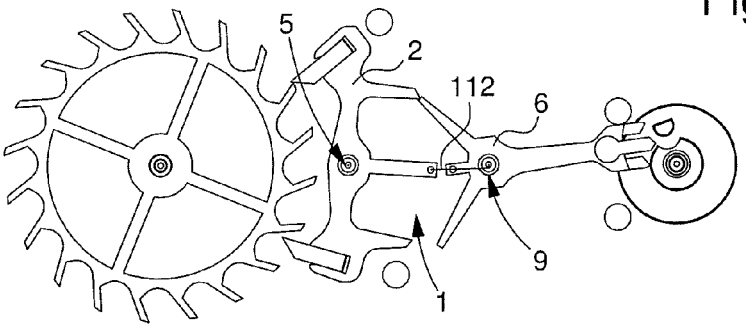
Fig. 33
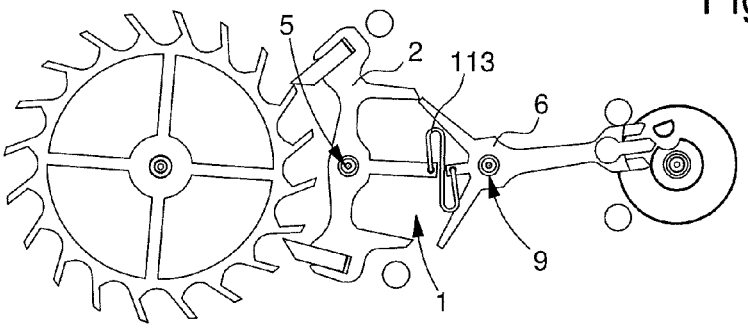

FLEXIBLE CONSTANT-FORCE PALLET LEVER

CROSS-REFERENCE TO RELATED APPLICATIONS

This application is a division of U.S. patent application Ser. No. 14/426,616, filed on Mar. 6, 2015, the entire contents of which is incorporated herein by reference. U.S. application Ser. No. 14/426,616 is the National Stage of PCT/EP2013/068130, filed on Sep. 3, 2013. PCT/EP2013/068130 claims priority to European Patent Application No. 12183559.9, filed on Sep. 7, 2012.

FIELD OF THE INVENTION

The invention concerns a pallet lever for a timepiece escapement, comprising a pallet head carrying at least one entry pallet and/or one exit pallet and arranged to cooperate with an escape wheel, and further comprising a fork arranged to cooperate with a balance.

The invention further concerns a timepiece escapement mechanism including at least one main plate carrying an escape wheel and a balance cooperating with one such pallet lever.

The invention also concerns a timepiece movement including at least one such escapement mechanism.

The invention also concerns a timepiece including at least one timepiece movement and/or at least one escape mechanism of this type.

The invention concerns the field of timepiece escapement mechanisms.

BACKGROUND OF THE INVENTION

The regularity of operation of an escapement mechanism is conditional upon the proper control of maintenance of oscillations and particularly of the impulse, whose intensity may be irregular in a watch whose barrel torque varies.

The search for optimum operating security is a constant preoccupation of designers of timepiece movements.

FR Patent Application No 2928015A1 in the name of LENOBLE discloses a tangential impulse escapement device with a pallet lever for a watch, including a toothed escape wheel, a pallet lever and at least one sprung balance. The pallet lever is in two parts each pivoting on a distinct axis, the two parts are hinged to each other via two transmission arms terminating at their adjacent ends in a common hinge, so that the two parts of the pallet lever rotate at the same speed but in opposite directions. Each part of the pallet lever includes a locking pallet-stone and an impulse pallet-stone, the latter receiving impulses from the escape wheel teeth in a tangential manner. This escapement device includes two sprung balances with distinct axes of oscillatory rotation, and each part of the pallet lever comprises a fork engage able in driving mesh on an impulse pin of the corresponding sprung balance.

Patent Application No WO 2011/064682 A1 in the name of FERRARA concerns a pallet lever in two parts hinged to each other, the hinge including an eccentric cam integral with the part of the pallet lever carrying the horns and guard pin, and cooperating with a fork integral with the part of the pallet lever carrying the pallet-stones.

Patent Application No EP2444 860A1 in the name of AUDEMARS PIGUET RENAUD ET PAPI discloses a pallet lever which includes two parts, each pivoting about an axis, and hinged to each other, the pivoting of one of the parts causing the other to pivot with higher amplitude.

Patent No EP2105806 in the name of GIRARD PERREGAUX discloses an escapement mechanism arranged to transmits impulses from a drive source to an oscillating regulator such as a sprung balance, via a strip spring which works by buckling about an inflection point. This strip spring is capable of accumulating energy from the drive source between two impulses and transmitting it to the oscillating regulator on each impulse via first and second levers. To optimise adjustment of the tension of the strip spring, the spring is mounted on a frame which is deformable symmetrically relative to a first axis passing through the axes of rotation of the regulator, of the first and second levers, and through the inflection point, and relative to a second axis perpendicular to the first axis and passing through the ends of the strip spring.

SUMMARY OF THE INVENTION

The invention proposes both to regulate the intensity of the impulse applied to the balance and to reduce inertia in motion during the oscillation.

To this end, the invention further concerns a pallet lever for a timepiece escapement, comprising a pallet head carrying at least one entry pallet and/or one exit pallet and arranged to cooperate with an escape wheel, and further including a fork arranged to cooperate with a balance, wherein the angular position of said fork relative to said head is variable, and wherein the only direct, permanent, mechanical connection between said head and said fork is provided by at least one flexible strip, characterized in that the range of pivoting of said head and that of said fork are limited with respect to each other by stops, and in that said head includes at least a first arm including a first support and stop surface arranged to cooperate, in abutment or support, in certain relative positions of said head and said fork, with a second support and stop surface comprised in at least a second arm of said fork.

According to a feature of the invention, said pallet lever is made in one-piece with at least one flexible strip.

According to a feature of the invention, said pallet lever is made of silicon or silicon oxide or metallic glass or "LIGA" nickel-phosphorus.

The invention also concerns a timepiece escapement mechanism, including at least one main plate carrying an escape wheel and a balance cooperating with one such pallet lever, characterized in that said head and said fork are assembled to said main plate so that said at least one flexible strip is mounted prestressed buckled between said head at a first end and said fork at a second end, said pallet lever forming a bistable system including at least two stable states and two metastable states, and said two ends being either each free to pivot in a housing that is free to move or fixed relative to said main plate, or each fitted inside a housing that is free to move relative to said main plate and at least one said housing being then subjected to a return stress in the direction of the other said housing.

According to a feature of the invention, said pallet lever performs a closed cycle during which said flexible strip successively occupies four main configurations:

- after being recharged with energy by said escape wheel and during a transitional, high energy phase approaching a first energy pass, with a wavy Z-shaped profile;
- after the energy available to said bistable strip is released, passing over said first energy pass, in the form of an impulse given to said balance in a first direction, said strip occupies a second, stable, low energy position, with a convex arc profile;

after being recharged with energy by said escape wheel and during a transitional, high energy phase approaching a second energy pass, with a wavy S-shaped profile;

after the energy available to said bistable strip is released, passing over said second energy pass, in the form of an impulse given to said balance in a second direction opposite to said first direction, said strip occupies a second, stable, low energy position, with a concave arc profile.

The invention also concerns a timepiece movement including at least one such escapement mechanism.

The invention also concerns a timepiece including at least one timepiece movement and/or at least one escape mechanism of this type.

BRIEF DESCRIPTION OF THE DRAWINGS

Other features and advantages of the invention will appear upon reading the following detailed description, with reference to the annexed drawings, in which:

in FIG. 23 with first and second pivot axes in fixed positions relative to a main plate, and in FIG. 24 with the second axis in a mobile position, in translation here, and combined with an elastic return means.

FIGS. 30 and 31 show perspective and plan views of a variant of the invention, with two bistable strips each including one end fixed to a main plate (not shown), the head and the fork, which are partially superposed and which pivot about the same geometric pivot axis, being connected by a return spring.

FIGS. 32 and 33 illustrate variants of pallet levers with repulsive interaction, each with a respectively straight or S-shaped spring, prestressed between the head and fork of the pallet lever.

DETAILED DESCRIPTION OF PREFERRED EMBODIMENTS

The invention concerns the field of timepiece escapement mechanisms.

To improve the regularity of operation, the invention endeavours to achieve good control of the impulse.

A constant-force mechanism makes it possible to ensure reproducibility over time.

In particular, the use of a bistable element, inserted between the escape wheel and balance, makes it possible to restore energy to the balance, with regular intensity, which depends only on the intrinsic characteristics of the bistable element, and not on the barrel torque, transmitted by the escape wheel. According to the invention, this bistable element is formed by a pallet lever of a particular constitution.

Figure 21:
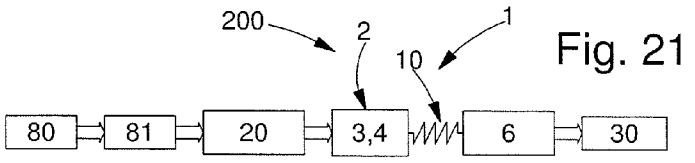
FIGS. 21 and 22 are block diagrams explaining constant-force mechanisms, including a flexible pallet lever in FIG. 21, and a bistable pallet lever in FIG. 22.
Figure 22:
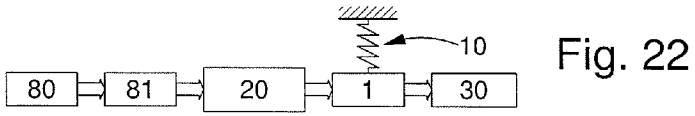

FIG. 21 shows the principle of a constant-force mechanism, with an energy transfer from a barrel 80 through a gear train 81 of an escape wheel 20 of a pallet lever 1 to a balance 30. This mechanism includes a flexible pallet lever in FIG. 21. FIG. 22 illustrates the configuration of a bistable pallet lever. The invention proposes to combine these two mechanism structures in order to achieve maximum regularity, with a high level of security, and a reduced number of components, and unlocking with no recoil.

To this end, the invention concerns a pallet lever 1 for a timepiece escapement, including a pallet head 2 carrying at least one entry pallet 3 and/or exit pallet 4 and arranged to cooperate with an escape wheel 20. Pallet assembly 1 also includes a fork 6 arranged to cooperate with a balance 30. The angular position of fork 6 is variable relative to head 2.

According to the invention, a repulsive interaction is created between head 2 and fork 6.

This is a transfer of energy, in a discontinuous manner, from the escape wheel to the balance, passing through the pallet lever, which serves as energy buffer. It is an object of the invention to minimise the motions of the mechanical components. The release of energy from the pallet lever to the balance is carefully designed to take the form of an impulse. Thus, the pallet lever includes means of storing and releasing energy, according to the respective positions of these mobile components, here head 2 and fork 6. It is to be noted that intermediate stages could be added between the head and the fork, without departing from the invention. The preferred embodiment with a head and a fork has the advantage of minimising the number of components, especially as it is possible to form a one-piece embodiment.

The present description concerns a preferred embodiment wherein the repulsive reaction is achieved mechanically, with a prestressed mechanical element, and more particularly via a bistable strip. Other embodiments are possible: such as those of FIGS. 32 and 33, wherein each pallet lever includes a spring, respectively a straight 112 or S-shaped 113 spring, prestressed between head 2 and fork 6. This spring 112 or 113 repulses the two halves of the pallet lever, and is free to rotate about its ends, FIG. 32 shows in dotted lines the lever arm of the force, which is exerted in the direction of spring 112 acting on fork 6. In other non-illustrated embodiments, the repulsion is not mechanical in nature, but magnetic and/or electrostatic in nature between a head and a fork 6, preferably mounted to pivot about two pivot axes 5 and 9.

Head 2 and fork 6 preferably follow axes of motion, which are illustrated here with a particular embodiment wherein these are pivot axes. Indeed, the motions of head 2 and fork 6 are independent, and may, in theory, follow any type of kinematics, provided they are compatible with the transfer of energy between the escape wheel and the balance.

Unless otherwise specified, the following description concerns a preferred embodiment of the invention, illustrated by FIGS. 1 to 20, wherein pallet lever 1 exhibits bistable behaviour, and comprises at least one bistable element, preferably at least one flexible strip 10. A flexible strip is simple to produce; the bistable element may take other forms without departing from the invention.

The invention further concerns a timepiece escapement mechanism 100 including at least one main plate 40 carrying an escape wheel 20 and a balance 30 cooperating with one such pallet lever 1.

According to the invention, head 2 and said fork 6 are assembled, directly or indirectly, to main plate 40 so that the at least one flexible, prestressed buckled strip 10 is mounted between head 2 at a first end 101 and fork 6 at a second end 102, said pallet lever 1 forming a bistable system having at least two stable states and two metastable states. These two ends 101, 102 are:

- either each free to pivot in a housing 1010, 1020 which is free to move or fixed relative to main plate 40;
- or each embedded inside a housing 1010, 1020 which is free to move relative to plate 40, and at least one of these housings 1010, 1020 is then subjected to a return force in the direction of the other housing, respectively 1020, 1010;
- or each embedded inside a housing 1010, 1020, one of these housings 1010, 1020 being free to move relative to plate 40, and the other housing 1020, 1010 then being fixed relative to plate 40, the housing that is free being returned towards the other by elastic return means 401, 402.

Figure 41:
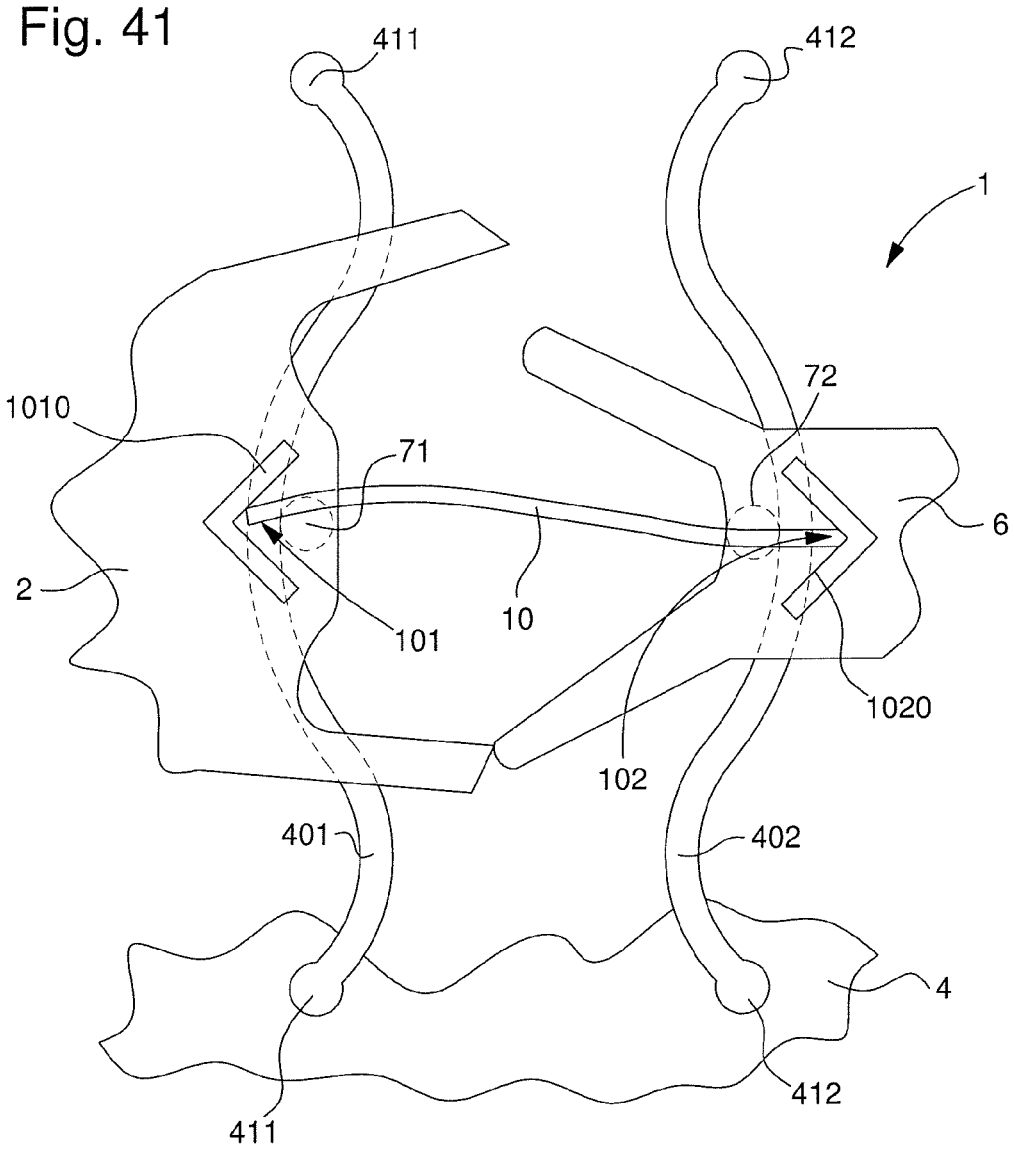
FIG. 41 illustrates a configuration wherein the two ends of the flexible strip each pivot in a housing which is subjected to a return force applying buckling prestress to the flexible strip.

FIG. 41 illustrates a particular configuration wherein the two ends 101, 102 of flexible strip 10 each pivot in a housing 1010, 1020, which is V-shaped here, respectively carried by head 2 and fork 6. Head 2 includes a trunnion 71 which is supported on a spring arm 401 fixed to plate 4 by securing elements 411, this spring tends to push head 2 towards fork 6; likewise, fork 6 includes a trunnion 72 which is supported on a spring arm 402 fixed to plate 4 by securing elements 412, the spring tends to push fork 6 towards head 2.

Thus, at least one of the two housings 1010, 1020, and both in the particular example of FIG. 41, is subjected, directly or indirectly (in this case via head 2 or fork 6 in the case of FIG. 41) to a return force applying buckling prestress to flexible strip 10.

For the sake of clarity, the invention is described here in the particular case of a single flexible, bistable mounted strip 10, in FIGS. 1 to 20. FIGS. 30 and 31 illustrate an example with two flexible strips; other arrangements are naturally possible.

The only direct, permanent, mechanical connection between head 2 and fork 6 is provided here by at least one flexible strip 10, i.e. by a single flexible strip 10, or by a plurality of such flexible strips 10 mounted in a similar buckled prestressed manner.

For pallet lever 1 to behave as a bistable element, strip 10 is prestressed in the operating position of pallet lever 1. As will be seen in the following description, prestressing can be achieved:

by displacement by application of a force or torque by manufacture.

Flexible strip 10 operates by buckling. The prestress is adjustable where a force or a torque is applied.

Consequently, in an advantageous embodiment of the invention illustrated by the Figures, in the free state, strip 10 has a different geometry from the shapes that it can take when pallet lever 1 is incorporated in an escapement mechanism 100 and fixed to a plate 40.

Pallet lever 1 includes, for attachment to a plate 40, first securing and/or guide means carried by head 2 and second securing and/or guide means carried by fork 6. Each of these two main components, head 2 and fork 6, may have conventional mechanical connections, such as pivot or translation guides, or include one or more fixed points of anchorage relative to plate 40 and include flexible portions providing pivoting and/or translational mobility relative to the plate, as described in PCT Application No EP2011/061244 or in Patent Application No EP2455821 by the same Applicant, in a configuration which will be referred to as a "virtual pivot" in the following description.

In a particular embodiment shown in FIGS. 1 to 20 and 30 and 31, pallet head 2 is mobile relative to a first pivot axis 5 or pivots about said first axis 5, and fork 6 is mobile relative to a second pivot axis 9 or pivots about this second axis 9. In FIGS. 1 to 20, second axis 9 is distinct from first axis 5.

The particular embodiment of FIGS. 1 to 20 is non-limiting, and concerns a particular case where head 2 is mounted to pivot about a first pivot axis 5. In this same particular variant, fork 6 is mounted to pivot about a second pivot axis 9 of first axis 5. In one embodiment, as illustrated, where head 2 and fork 6 are substantially coplanar, these axes 5 and 9 are preferably distinct. Other embodiments are possible, as in FIGS. 30 and 31 which show a tiered variant, where axes 5 and 9 are geometrically merged: pallet lever 1 then comprises two bistable strips 10S and 10J, each including a first end 10ES, 10EJ fixed to a plate (not shown), and a second end 103S, 103J respectively embedded in fork 6 and head 2. Head 2 and fork 6 are partially superposed and pivot about the same geometric pivot axis P, and are connected by a loop-shaped return spring 104, hooked at 104S in fork 6 and at 104J in head 2. This spring 104, which acts as a buffer spring, has a higher torque than that of the bistable strip.

Figure 37:
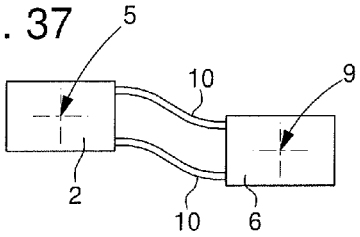
FIG. 37 illustrates another embodiment of the pallet lever with two flexible bistable strips.

FIG. 37 illustrates another embodiment of the pallet lever with two flexible, bistable strips, coplanar with head 2 and fork 6.

Other variants are also possible, for example with a substantially linear oscillating motion of head 2 relative to the line of centres between escape wheel 20 and balance 30, and a pivoting motion of fork 6 about an axis 9.

In a particular embodiment also illustrated in the Figures, fork 6 carries a guard pin 7 with a shock-resistant function for cooperating with a passing hollow 34 of a roller 31 of balance 30 and at least one horn 8, here two horns 8, for cooperating with an impulse pin 35 of balance 30 for the impulse function.

Pallet lever 1 is hinged, i.e. head 3 and fork 6 are movable in relation to each other and indirectly connected to each other by at least one intermediate component, here a flexible strip 10, ensuring their relative mobility of motion.

This bistable element preferably takes the form of an embedded beam. In a particular embodiment illustrated by the Figures, this beam is embedded at both ends: the distance between the two ends is less than the length of the beam at rest, which makes it possible to have two stable positions, and at least one metastable position. The energy stored in the bistable element can be calculated as a function of the angles formed by bistable strip 10 at the two ends thereof; or, in the case of several bistable strips, the angles formed by each strip, at each of the ends thereof, with one of the components of pallet lever 1, head 2 or fork 6, or plate 40 or other intermediate component according to the case. A combination of several strips can enable more stable states to be obtained, for example three stable states by combining three strips.

The ends of the beam may each be, in particular, embedded:

or on an arbor that pivots freely:

or in a plate to form a flexible pivot.

This at least one bistable element or flexible bistable strip 10 is mounted, prestressed buckled, between head 2 and fork 6. Preferably, the only direct, permanent, mechanical connection between head 2 and fork 6, i.e. apart from their pivots or securing elements to plate 40 or suchlike, is provided by this at least one bistable strip 10.

In the version illustrated, flexible strip 10 includes a first end 11 angularly integral with head 2 and disposed in immediate proximity to first axis 5, and a second end 12 angularly integral with fork 6 and disposed in immediate proximity to second axis 9.

It is clear here that first axis 5 and second axis 9 are geometrical axes about which the pivoting of head 2 and fork 6 occurs. These axes do not necessarily correspond to conventional physical pivots, they may also correspond to flexible pivots or virtual pivots.

Figure 34:
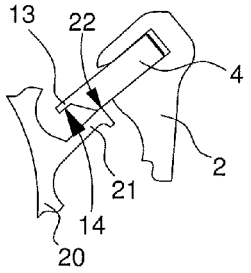
FIG. 34 illustrates a variant of the pallet-stone of the head.

In the particular non-limiting version illustrated in the Figures, similar to a Swiss lever, this pallet lever 1 carries an entry pallet 3 and an exit pallet 4. In a particular variant, the entry pallet 3 and/or the exit pallet 4 includes a protruding tongue-shaped end 13 seen in FIG. 34, opposite first axis 5 and including a flat surface 14 able to receive in abutment a tip 22 of a tooth 21 of an escape wheel 20, as seen in FIG. 34.

In a preferred embodiment, the pallet lever 1 for a timepiece escapement includes a pallet head 2 carrying at least one entry pallet 3 and/or one exit pallet 4 and arranged to cooperate with an escape wheel 20 and further comprises a fork 6 arranged to cooperate with a balance 30. The angular position of fork 6 is variable relative to head 2, and the only direct, permanent, mechanical connected between head 2 and fork 6 is provided by at least one flexible strip 10.

According to the invention, the range of pivoting of head 2 and that of fork 6 are limited with respect to each other by stops, and head 2 includes at least a first arm 15 including a first support and stop surface 16 arranged to cooperate, in abutment or support, in certain relative positions of head 2 and fork 6, with a second support and stop surface 18 comprised in at least a second arm 17 of fork 6.

The term "arm" 15 or 17 should not be understood in a limiting sense, although, in the embodiment illustrated by the Figures, this component adopts an elongated shape, this arm 15 or 17 can take any shape compatible with the kinematics of the pallet lever.

Advantageously, the clearance, notably the range of pivoting in the case of FIGS. 1 to 20, of head 2 and that of fork 6 are therefore limited with respect to each other by stops.

In a particular preferred embodiment, head 2 includes at least a first arm 15 including a first support and stop surface 16 arranged to cooperate, in abutment or support, in certain relative positions of head 2 and fork 6, with a second support and stop surface 18 comprised in at least a second arm 17 of fork 6.

These arms 15 and 17 enable the pallet-stones to be unlocked properly at impulse, while robustly stopping the escape wheel once winding of the bistable element is complete.

In the variant illustrated, head 2 includes two first arms 15A, 15B, with first surfaces 16A, 16B cooperating with second surfaces 18A, 18B of second arms 17A 17B of fork 6.

In a particular and advantageous embodiment, pallet lever 1 is made in one-piece with said at least one flexible strip 10 or bistable element: head 2, strip 10 and fork 6 are a single component.

In particular in this version, pallet lever 1 is advantageously made of silicon, or silicon oxide or metallic glass, or "LIGA" nickel-phosphorus (notably obtained via a "LIGA" method). Indeed, the prestressing of the bistable element or of bistable strip 10 is very low, in particular close to 5 micrometers, and adjustment thereof is possible, but difficult, where the components are produced assembled to each other.

Applying a prestress of 8 μm between the ends of a flat strip spring made of NiP, produced by a LIGA process, and having dimensions of 2.1×0.10×0.02 mm, with working angles ranging from −7° to +7° (defined by the stops), the difference in energy, between wavy positions (with a maximum stress level close to 400 MPa) and positions in a simple concave or convex arc, corresponds to a crossing between energy passes of 0.5 μJ and then energy wells of 0.13 μJ, i.e. a difference of 0.37 μJ, which is comparable to the energy available to the escape wheel of ETA calibre 2824-2 at each vibration. These dimensions are thus sufficient to provide an impulse of normal intensity.

In another particular embodiment, pallet lever 1 comprises a first flexible pivot 61 and/or a second flexible pivot 62 forming a flexible guide member respectively on first axis 5 and/or second axis 9.

In a particular embodiment, pallet lever 1 includes a first flexible or virtual pivot 61 and a second flexible or virtual pivot 62 at the two ends 101, 102 of the at least one flexible strip 10, each forming a flexible guide member respectively on first axis 5 and second axis 9.

Figure 39:
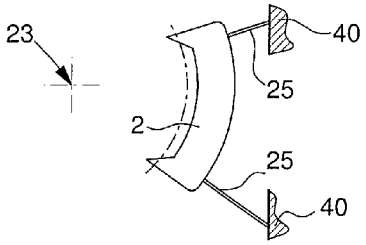
FIG. 39 illustrates a head with a virtual pivot, incorporated in a pallet lever according to the invention.

This first flexible pivot 61 and/or second flexible pivot 62 may also be a virtual pivot. For example, FIG. 39 gives the example of head 2 connected to plate 40 by two strips 2S and 2J and whose first flexible pivot is merged with pivot axis 23 of escape wheel 20.

Figure 18:
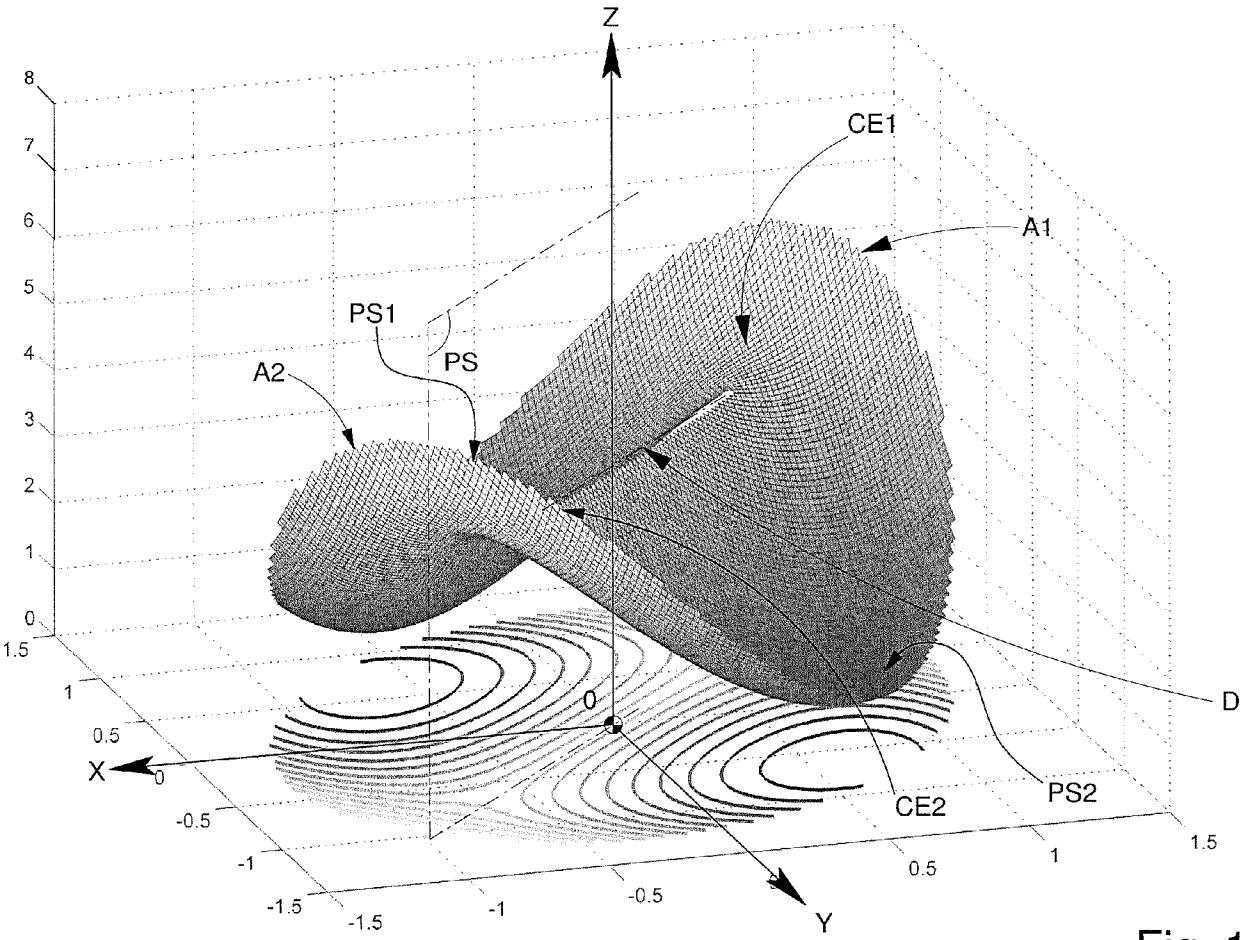
FIG. 18 shows a schematic, three-dimensional diagram representative of the energy in the flexible bistable strip.

FIG. 18 shows a diagram of the distribution of energy in flexible strip 10 or the bistable element: the angles formed by each of the two ends 101, 102 of strip 10 with their respective points of attachment or embedding 11,12 in pallet head 2 and fork 6 are shown at X and Y.

Figure 19:
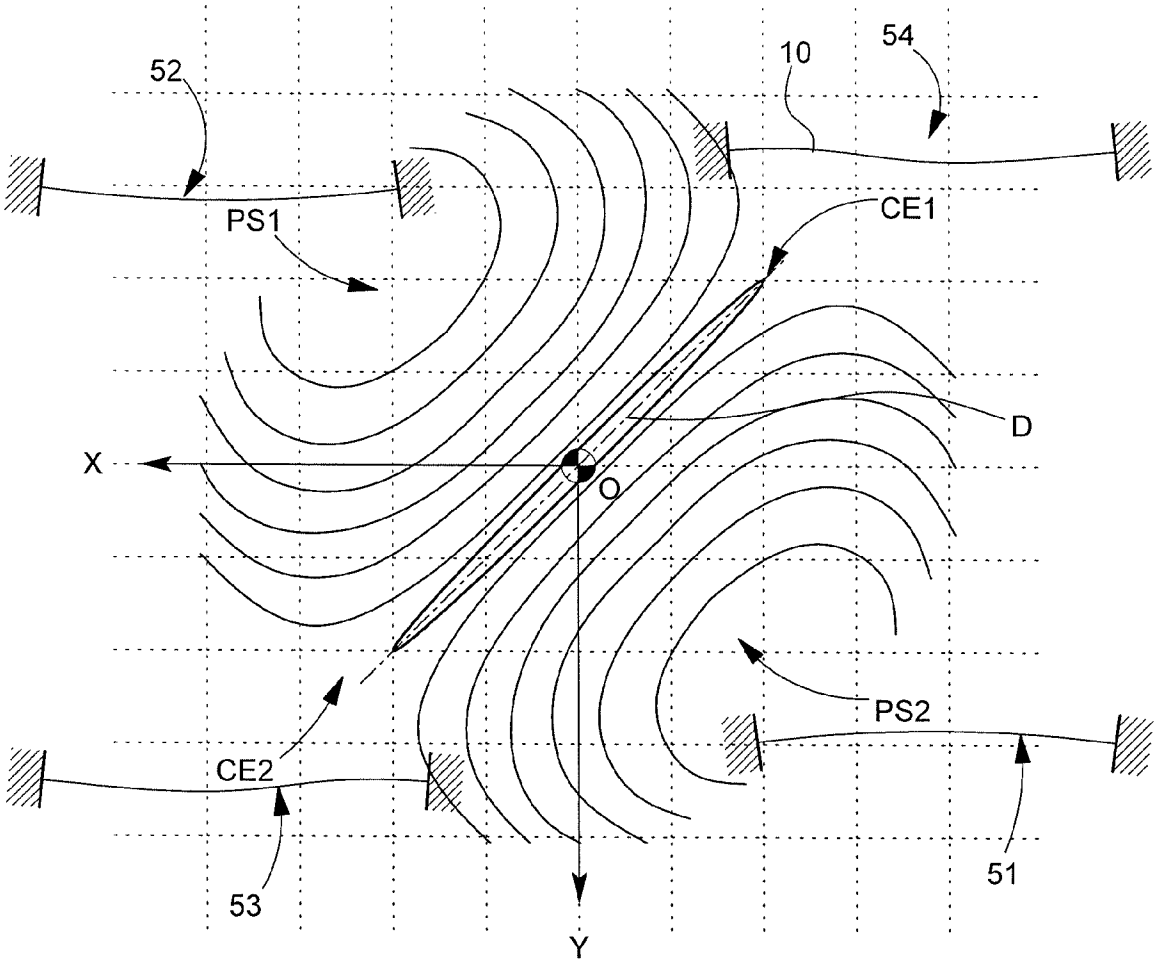
FIG. 19 is a projection on the base plane of the diagram of FIG. 18, in which a rectangle delimits the variations in energy in the flexible bistable strip during the escapement cycle.

A level of energy, randomly graduated from 0 to 8, is shown at Z. FIG. 19 shows the projection onto plane XOY of this energy distribution surface, with the corresponding energy level curves.

This energy distribution is saddle-shaped, symmetrical relative to a vertical plane PS oriented along the line bisecting axes OX and OY. A very high energy ridge D (6 to 8) extends in this plane of symmetry PS. Ridge D is delimited by two energy passes, first energy pass CE1 and second energy pass CE2, which each extend between two steep slopes between ridge D and areas of low energy, called energy wells, corresponding to first stable position PS1 and second stable position PS2 (troughs in the energy surface). In the extension of ridge D and beyond, energy passes CE1 and CE2 are each bordered by a low energy area A1 and A2 respectively. These energy passes CE1 and CE2 correspond to two metastable positions.

FIG. 19 shows that flexible strip 10 cannot take any energy position on surface T 18: the end portions of pallet lever 1, in this case head 2 and fork 6, have a range of motion that is limited, either by second banking pins 41A and 41B as regards fork 6, or by second arms 17A, 17B of fork 6 which limit the pivoting of head 2. Bistable strip 10 always pushes these end portions, head 2 and fork 6 of pallet lever 1 against these stops. Consequently, if one of these ends is fixed, and the other is free to move, motion is always on the edges of rectangle R, as shown schematically in FIG. 20, which summarises the energy levels corresponding to each of the phases described in FIGS. 1 to 17, in a simplified manner, with the energy path being almost rectilinear, and the rectangular shape of the energy path being a good approximation. Thus, the pivoting of head 2, like that of fork 6, is angularly limited by stops. In the particular case of the illustrated variant, the stops limiting the angular motion of head 2, respectively of fork 6, are mobile and formed by surfaces of fork 6, respectively of head 2.

The banking pins 41 are shown here underneath the plate. It will be noted that they may take other positions, for example in the form of flat portions underneath teeth 21 of escape wheel 20.

In the example illustrated by the Figures, pallet lever 1 thus performs a closed cycle during which flexible strip 10 successively occupies four main configurations:

- after being recharged with energy by escape wheel 20 and during a transitional, high energy phase approaching a first energy pass CE1, with a wavy Z-shaped profile in the Figures, referenced 54;
- after the energy available to bistable strip 10 is released, passing over said first energy pass CE1, in the form of an impulse imparted to balance 30 in the first direction, for example anticlockwise, strip 10 occupies a second, stable, low energy position PS2, with a convex arc profile, referenced 51;
- after being recharged with energy by the escape wheel and during a transitional, high energy phase approaching a second energy pass CE2, with a wavy S-shaped profile in the Figures, referenced 53;
- after the energy available to strip 10 is released, passing over said second energy pass CE2, in the form of an impulse imparted to balance 30 in the second direction, for example clockwise, strip 10 occupies a first, stable, low energy position PS1, with a concave arc profile, referenced 52.

Naturally, the shape of the prestressed beam formed by bistable strip 10 is a non-limiting example. The concave, convex, S-shaped and Z-shaped geometries that strip 10 can occupy are specific to the present case. A more complex geometry can also be used in the stable rest state, for example S or Z shaped.

The preferred choice of following a rectangle R, rather than a square, is explained by the objective of stopping before the energy pass, when bistable strip 10 is strung Indeed, the risk of stopping on the energy pass in an unstable position is that, with a very small shock, bistable strip 10 could tip, and guard pin 7 would then be blocked by the balance roller and permanently rub against the roller, which is detrimental for operation and impairs efficiency. Thus, the stops are preferably arranged to stop bistable strip 10 before first energy pass CE1 or second energy pass CE2, when bistable strip 10 is strung and recharged with energy.

Stops limiting the angular motion of head 2, respectively of fork 6 are advantageously mobile and formed by surfaces of fork 6, respectively of head 2.

In the Figures, the angular motion of head 2 is limited by stops formed by two arms 17A, 17B comprised in fork 6.

Surfaces 18A, 18B form stops equivalent to achieving lock with no draw device. Preferably, as seen in FIG. 1, they have a profile in an arc of a circle A centred on the second pivot axis 9 so that, when impulse pin 35 of balance 30 starts to drive fork 6 (from phase T2 to phase T3 hereafter), head 2 does not rotate, there is therefore no friction to overcome.

Each phase of the cycle bears the number of the corresponding Figure.

Figure 1:
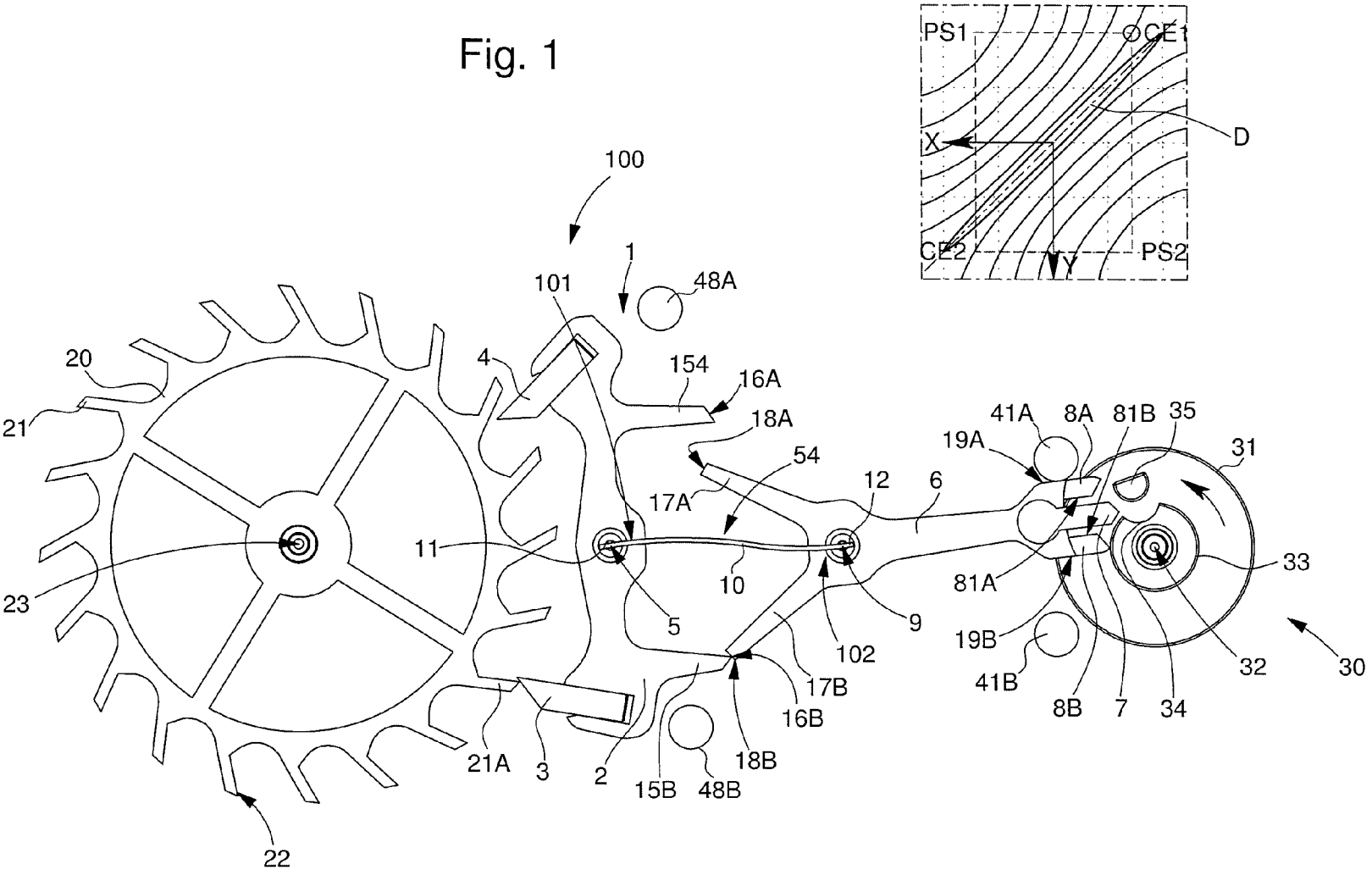
FIG. 1 shows a schematic, top view of an escapement mechanism including, between a conventional escape wheel and balance, a flexible pallet lever according to the invention, with a pivoting head and fork connected by a flexible, bistable, prestressed strip; this mechanism is shown in first phase of an escapement cycle.
Figure 2:
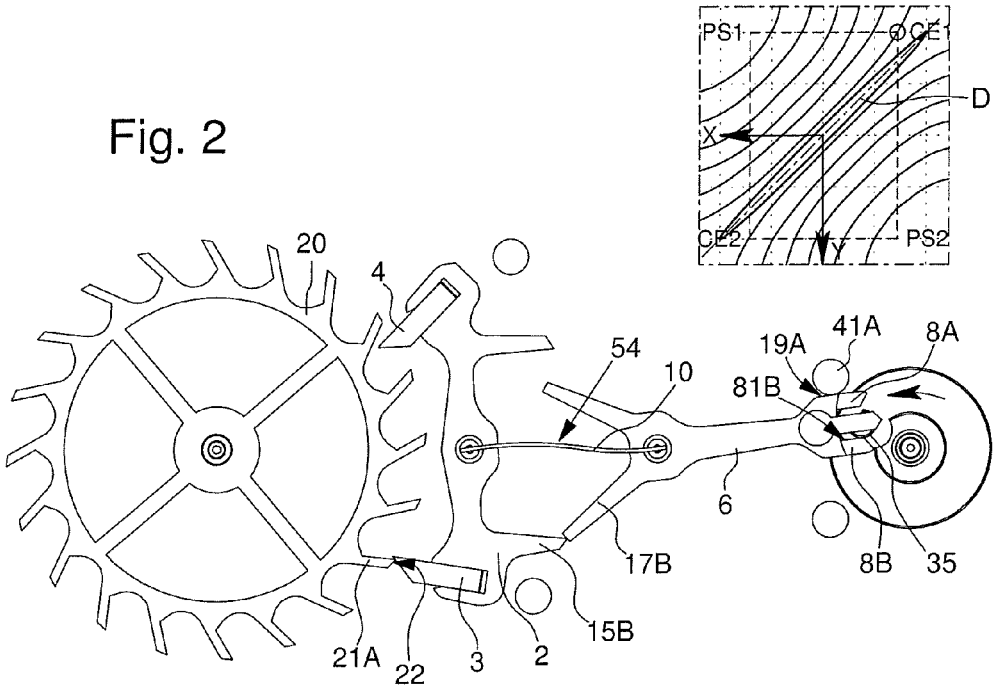
FIGS. 2 to 17 show, in a similar manner to FIG. 1, the successive phases of this cycle.
Figure 3:
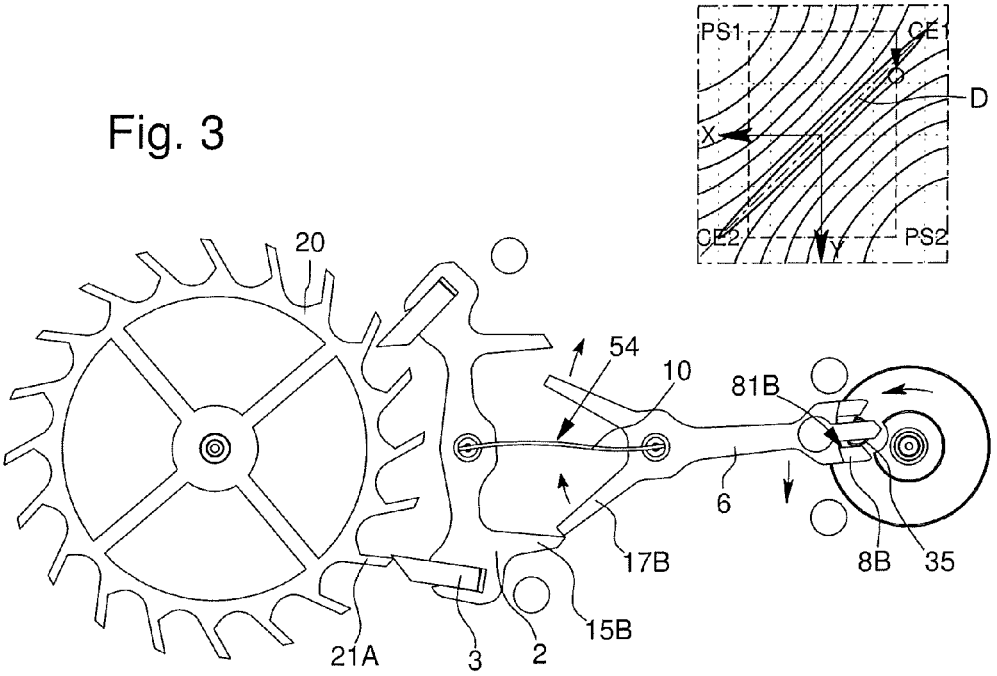
Figure 4:
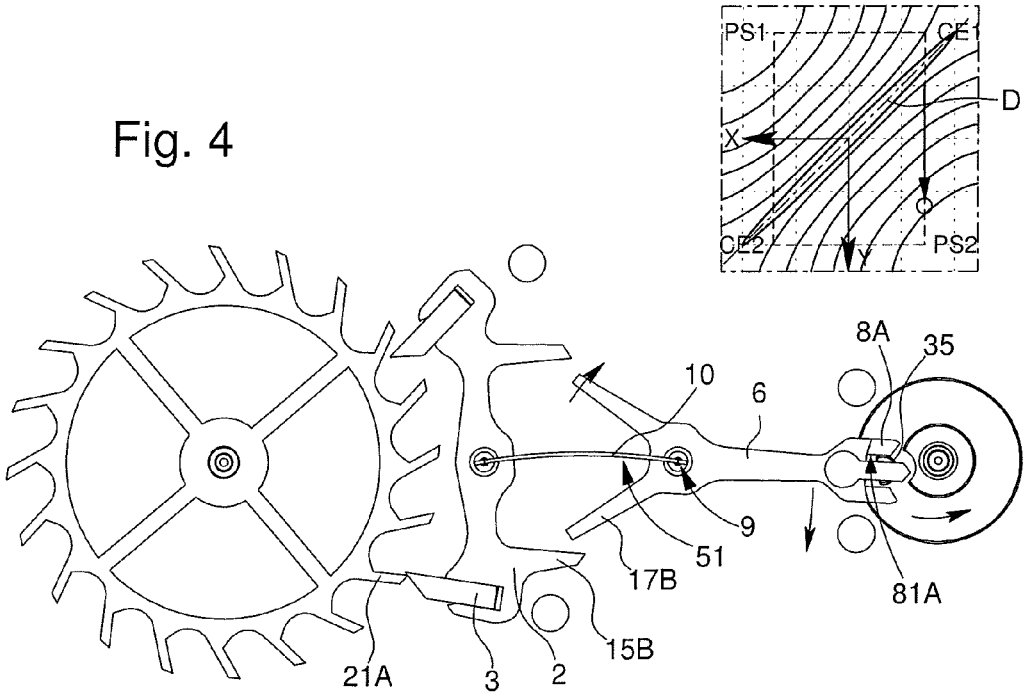
Figure 5:
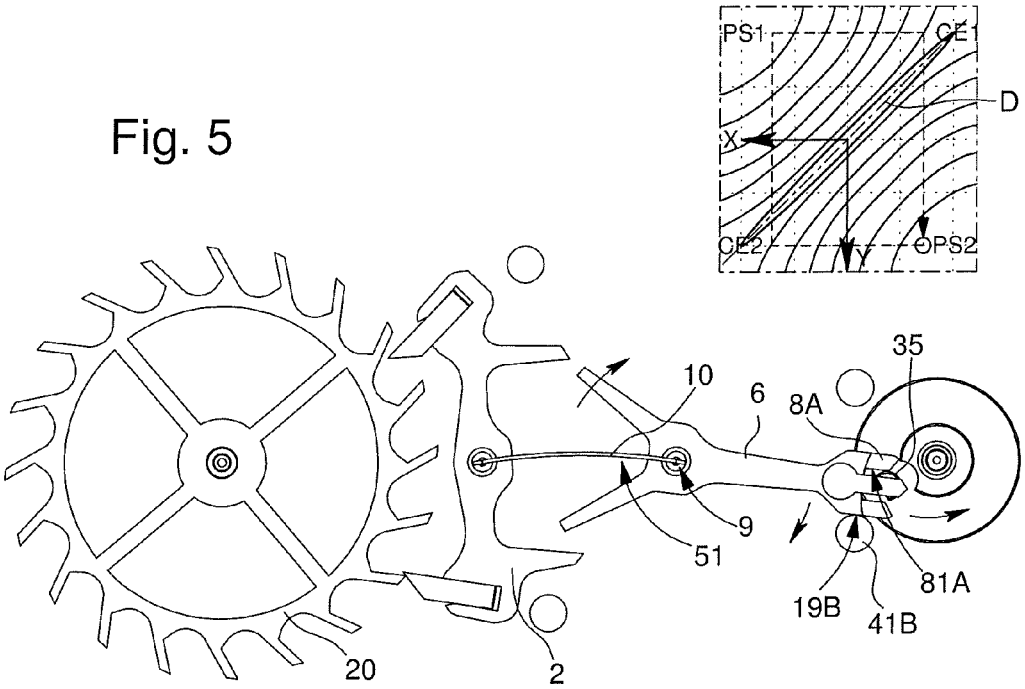
Figure 6:
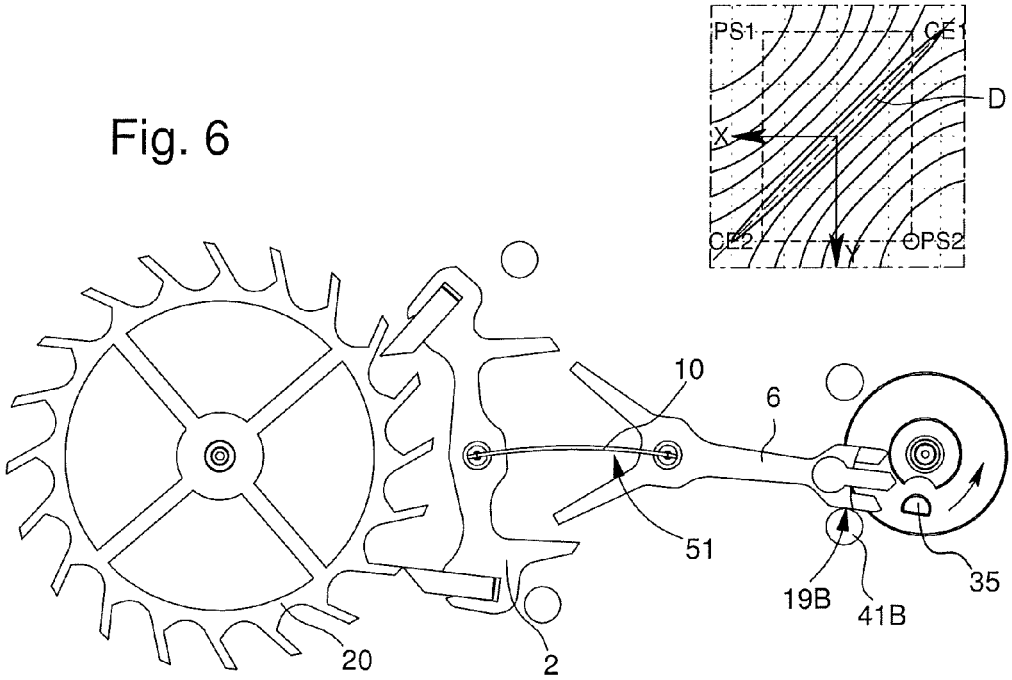
Figure 7:
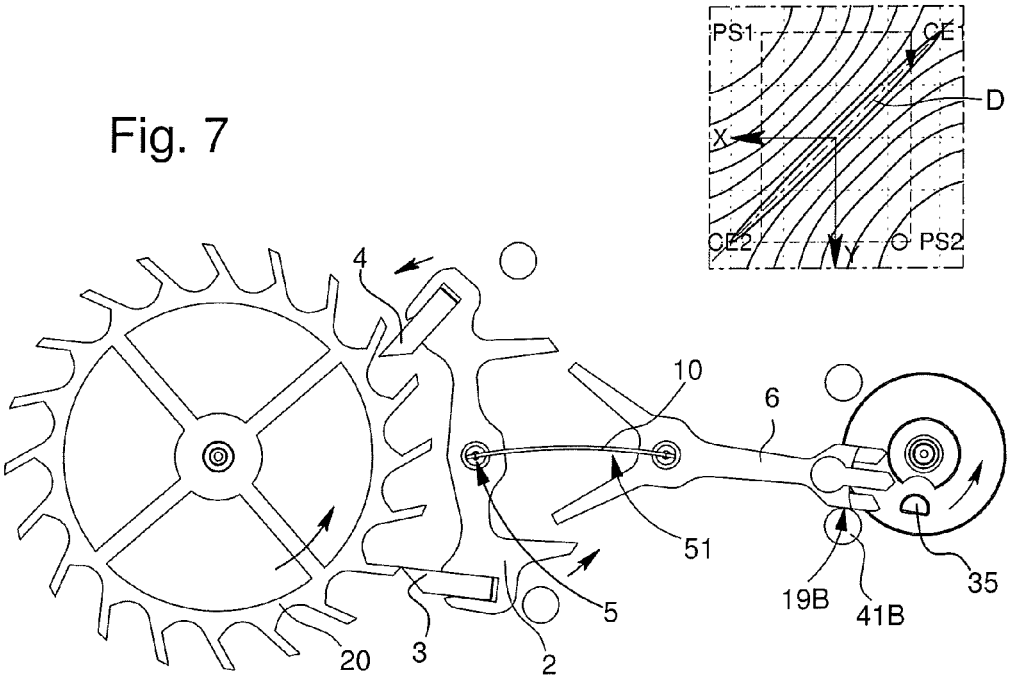
Figure 8:
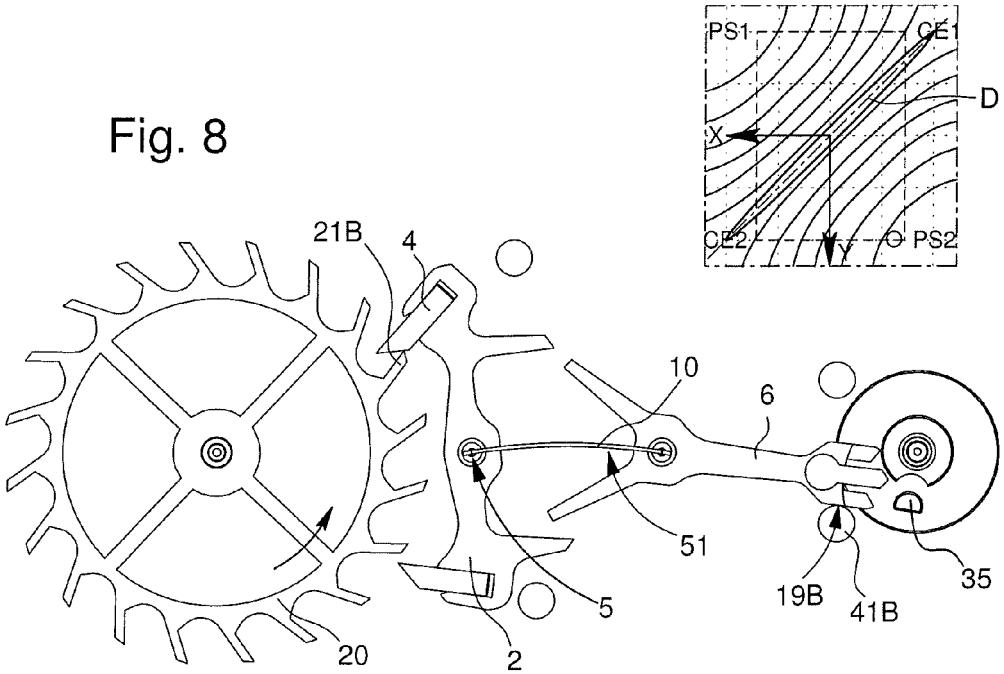
Figure 9:
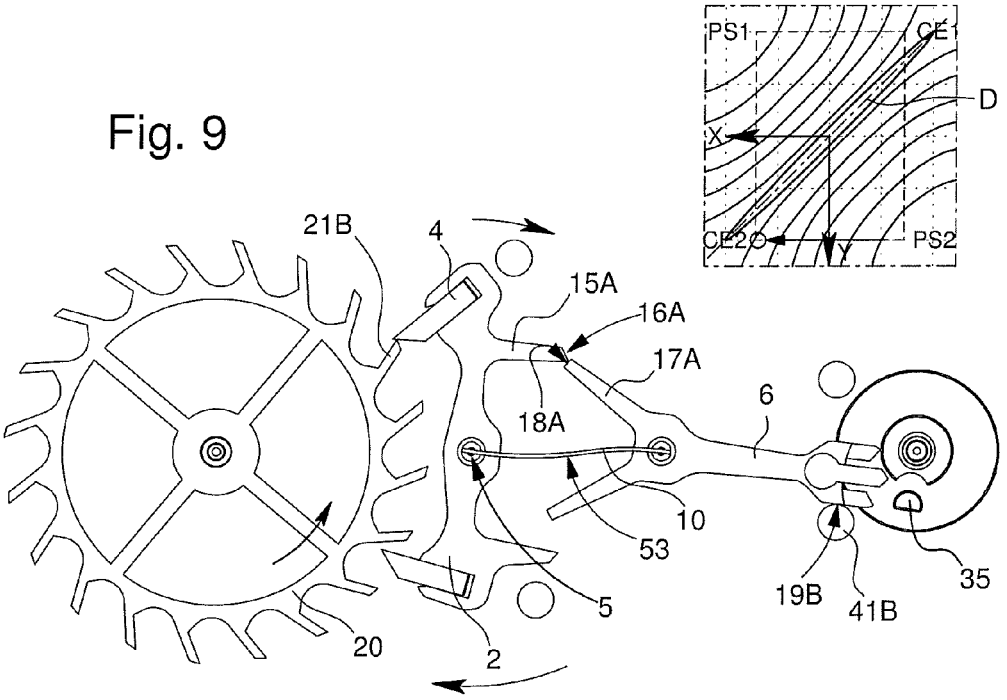
Figure 10:
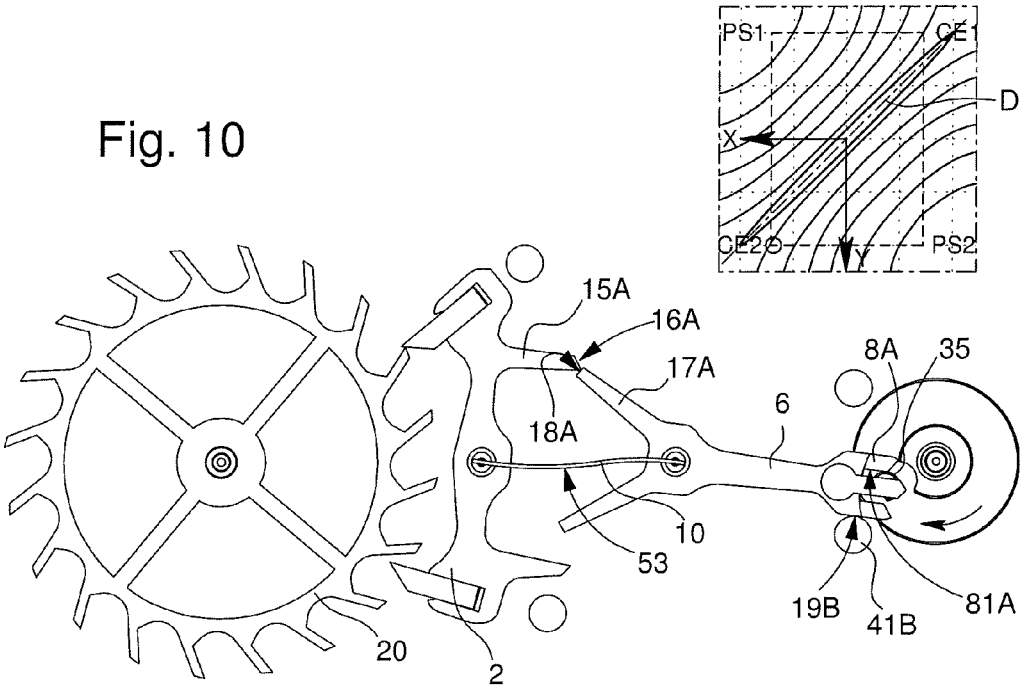
Figure 11:
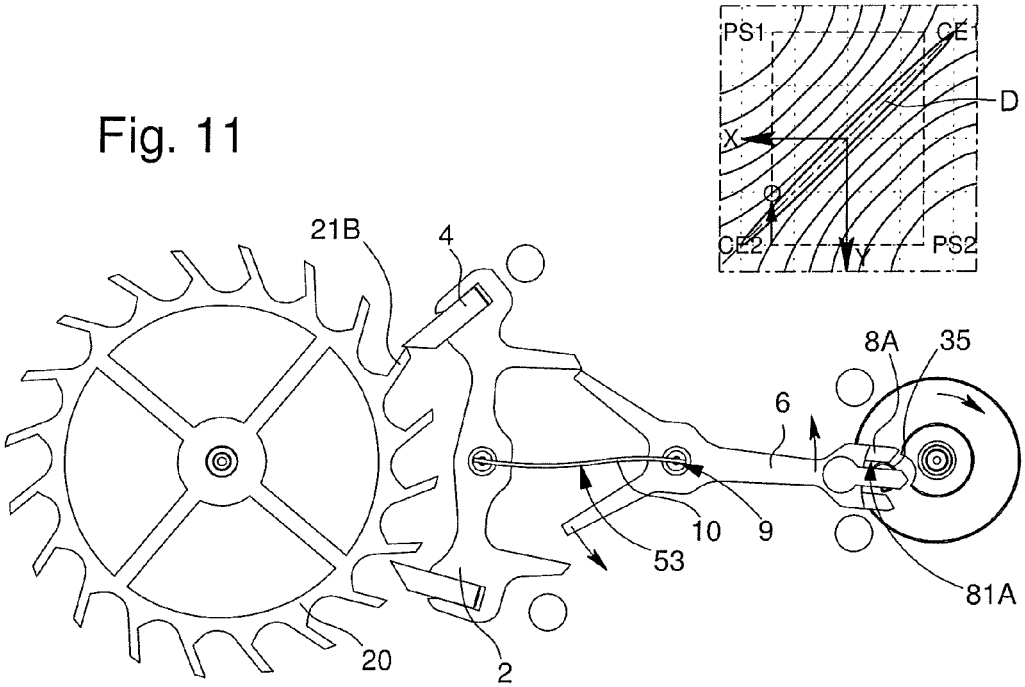
Figure 12:
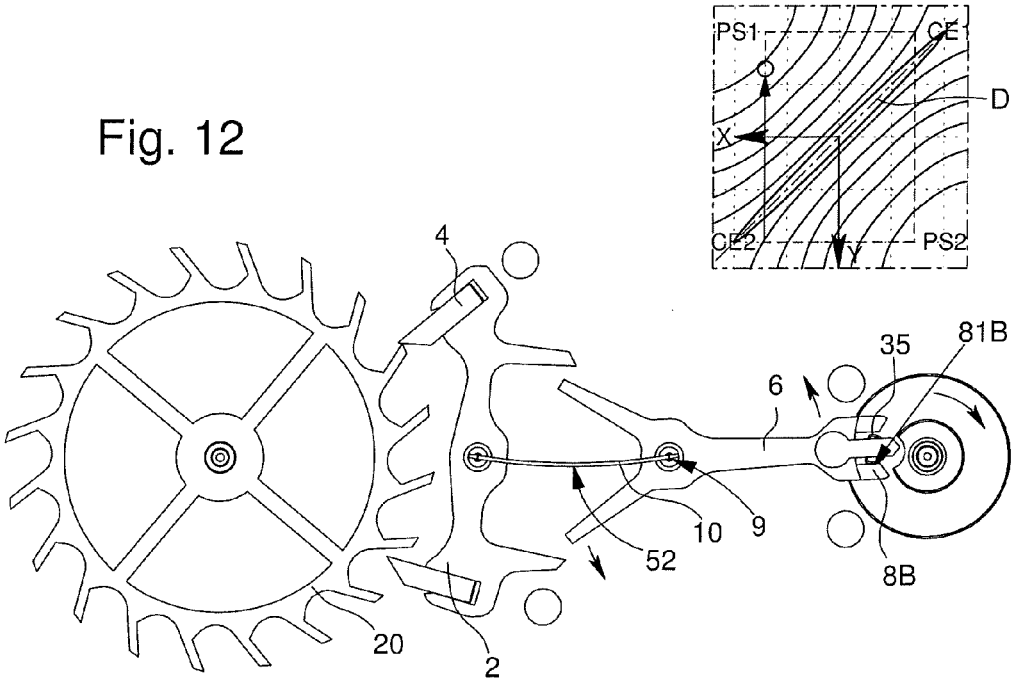
Figure 13:
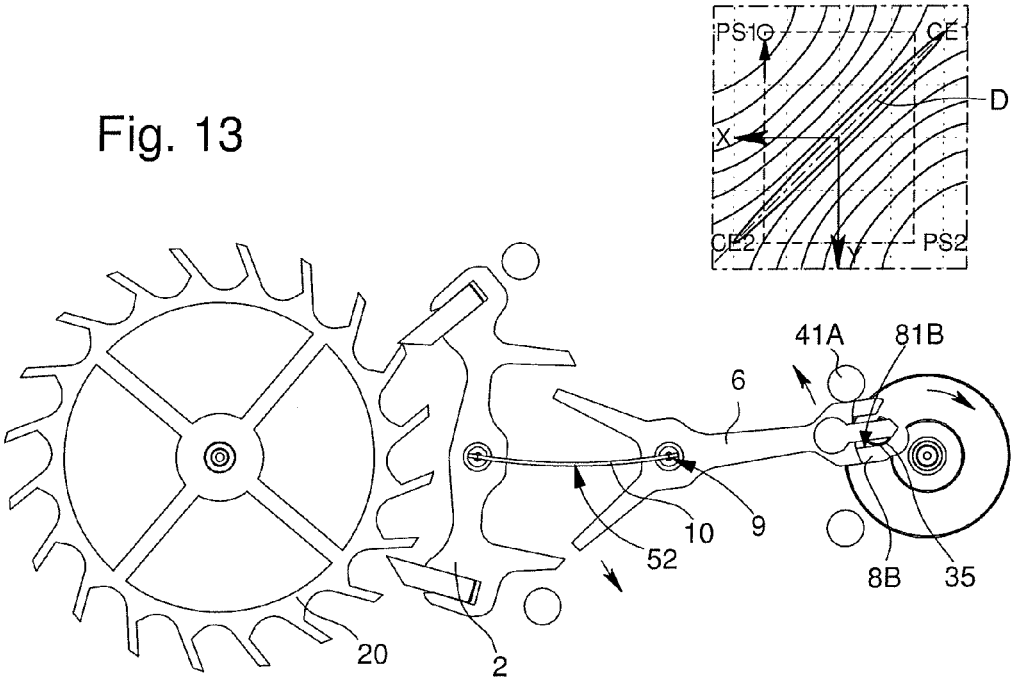
Figure 14:
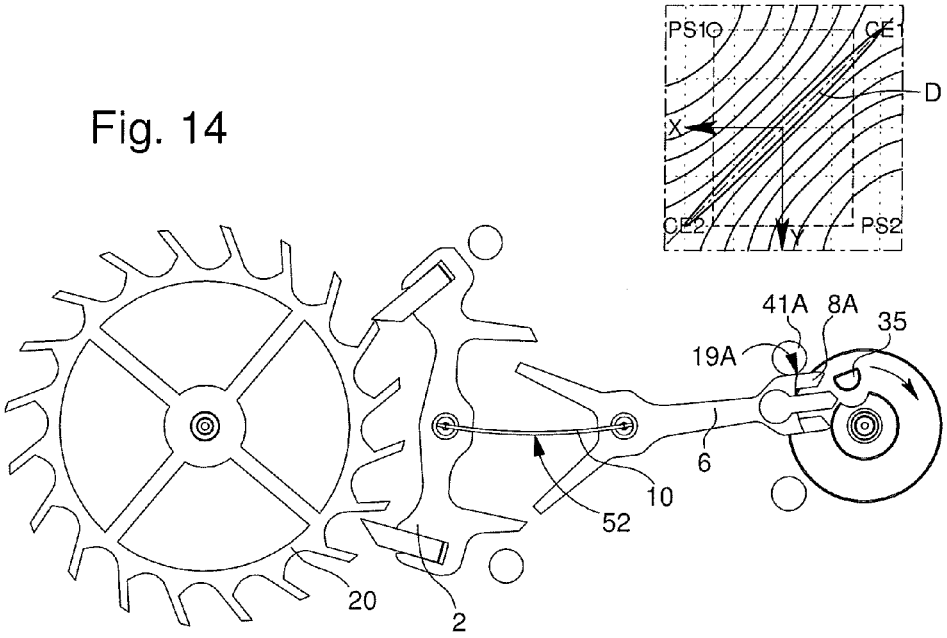
Figure 15:
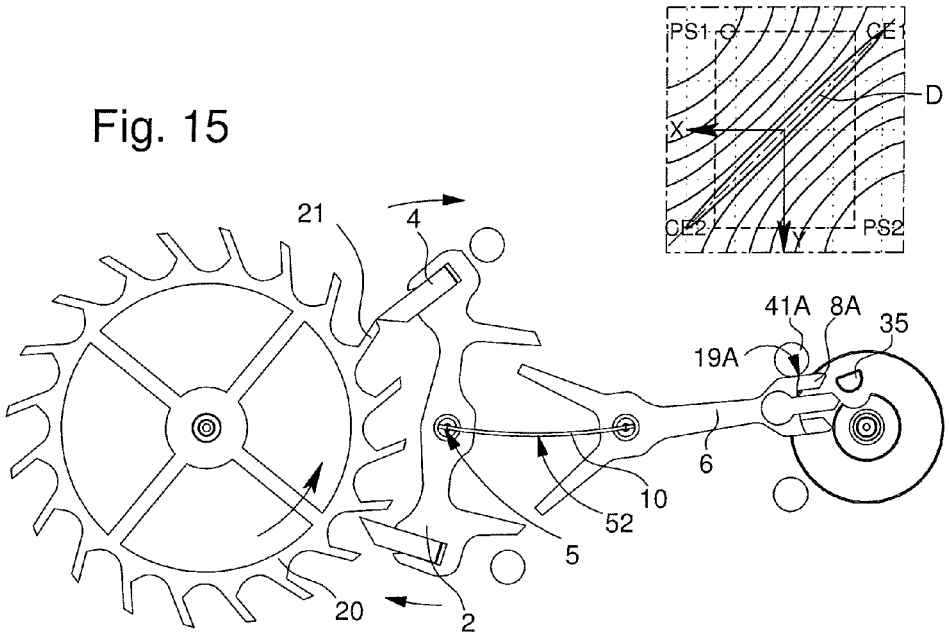
Figure 16:
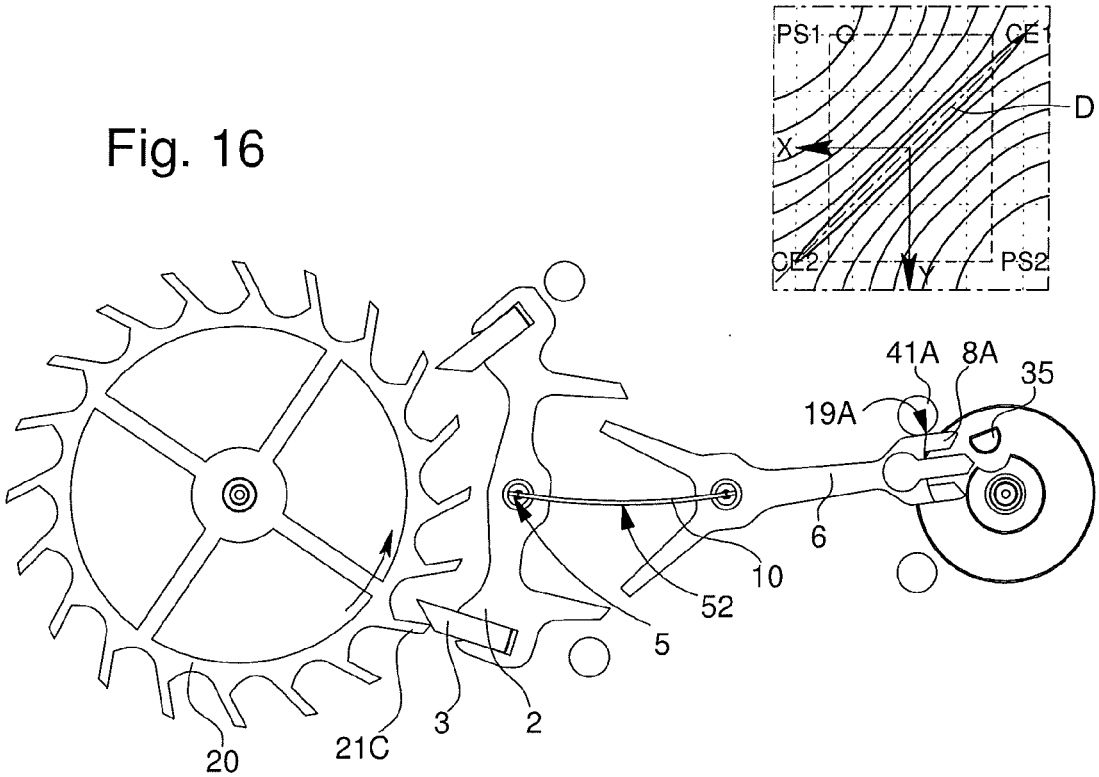
Figure 17:
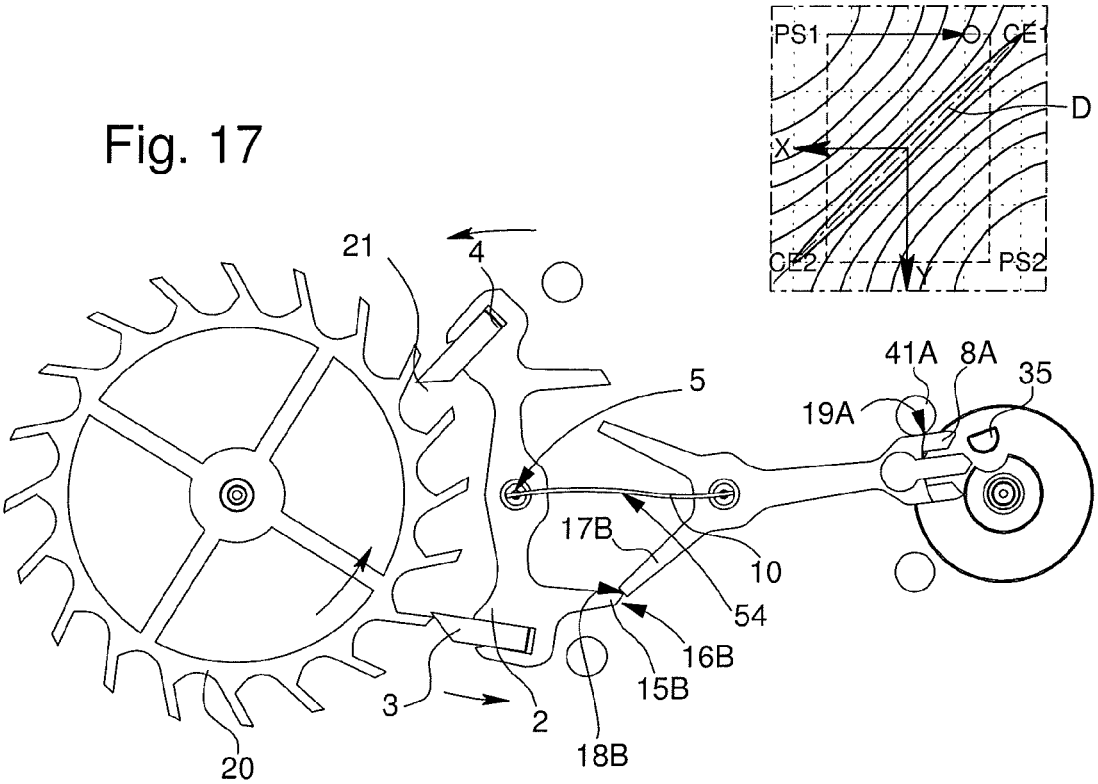

In the first phase T1 of FIG. 1:

- escape wheel 20 is immobile, its tooth 21A resting on entry pallet 3 of pallet head 2;
- pallet head 2 is immobile, its first arm 15B is stopped at its tip 16B by second support surface 18B of second arm 17B of fork 6; this locking mode illustrated in the Figures is non-limiting, it has the advantage of compactness and simplicity of production;
- bistable strip 10 is Z-shaped, referenced 54, close to energy pass CE1;
- fork 6 is immobile, its stop surface 19A is stopped on the corresponding banking pin 41A;
- free arc of the balance: balance 30 pivots in the first direction, for example anticlockwise, impulse pin 35 is in the 11 o'clock position.

In T2:

- wheel 20 remains immobile;
- head 2 remains immobile;
- strip 10 is Z-shaped, referenced 54, close to energy pass CE1;
- fork 6 remains immobile, resting on pin 41A;
- balance 30 pivots in the first direction, its impulse pin 35 in the 10 o'clock position rests on inner surface 81B of horn 8B, balance 30 thus starts to release fork 6.

In T3:

- wheel 20 remains immobile;
- head 2 is immobile, its first arm 15B stopped by second arm 17B, which initiates the release thereof, to enable head 2 to be released in the next phase; here too, alternative solutions are possible, without departing from the spirit of the invention;
- strip 10 is Z-shaped, referenced 54, and starts to cross energy pass CE1;

fork 6 pivots in a second direction, for example clockwise, its stop surface 19A has left pin 41A, its second arm 17B is on the point of leaving first arm 15B;

balance 30 pivots in the first direction, its impulse pin 35 in the 9 o'clock position rests on inner surface 81B of horn 8B, balance 30 thus releases fork 6.

T4 is a drive phase, where strip 10 crosses energy pass CE1, and imparts its impulse in the first direction, to balance 30;

wheel 20 is free to move, it still remains momentarily almost immobile due to its inertia;

head 2 is free to move, except for the connection to strip 10;

strip 10 crosses energy pass CE1, relaxes and changes into convex shape 51;

fork 6 pivots in a second direction, for example clockwise, releases head 2, the inner surface 81A of its horn 8A drives impulse pin 35 in the first direction, this is the impulse;

balance 30 pivots in the first direction, with its impulse pin 35 in the 9 o'clock position, driven by horn 8A.

T5 is the end of the impulse imparted to balance 30 by fork 6 which is stopped on its banking pin 41B;

wheel 20 is free to move, it still remains momentarily almost immobile due to its inertia;

head 2 is free to move;

strip 10 reaches a stable, low energy position PS2, in convex shape 51;

fork 6 pivots in the second direction, for example clockwise, inner surface 81A of its horn 8 loses contact with impulse pin 35, this is the end of the impulse phase;

balance 30 pivots in the first direction, impulse pin 35 in the 8 o'clock position loses contact with horn 8A.

In T6, it is only balance 30 that pivots, describing the free arc:

wheel 20 will start to pivot in the first direction;

head 2 is free to move;

strip 10 is in a stable, low energy position PS2, in convex shape 51;

fork 6 is immobile, its stop surface 19B resting on pin 41B;

balance 30 pivots in the first direction, its impulse pin 35 in the 6:30 position under the effect of the impulse.

In T7, escape wheel 2 is released by head 2:

wheel 20 pivots in the first direction;

head 2 pivots in the first direction;

strip 10 folds or unfolds slightly, because of the rotation;

fork 6 remains immobile, resting on pin 41B;

balance 30 pivots in the first direction, its impulse pin 35 reaches a 6 o'clock position under the effect of the impulse.

First banking pins 48A, 48B are advantageously placed in proximity to head 2, as security devices in the event of shocks or dynamic effects: for example, during the change from phase 6 to phase 7, where head 2 pivots in the second direction, for example clockwise: if it picks up too much speed, it risks going too far, whereas in phase 8 it must set off again in the opposite direction.

In T8, escape wheel 20 reaches another pallet-stone 4 of pallet lever 1. The drop, i.e. the angle through which escape wheel 20 moves freely between phases T7 and T8 may be too great for the conventional wheel 20 illustrated here for comprehension of the invention, it is useful to optimise the geometry of teeth 21 of wheel 20, and of pallet-stones 3 and 4 of head 2 to reduce the drop;

escape wheel 20 pivots in the first direction, until a tooth 21B is stopped on exit pallet 4;

head 2 is free to move and momentarily immobile;

strip 10 remains in stable position PS2, in convex shape 51;

fork 6 remains immobile, resting on pin 41B;

balance 30 is mobile, it continues its travel (its impulse pin 35 is in a 6 o'clock position);

In T9, the energy provided by escape wheel 20 enables bistable strip 10 to be strung and recharged with energy; strip 10 approaches the next energy pass CE2;

wheel 20 pivots in the first direction, in abutment on pallet-stone 4 and causes head 2 to pivot;

head 2 pivots in the second direction, for example clockwise, and moves into abutment, its first arm 15A is stopped at its tip 16A by the second stop surface 18A of second arm 17A of fork 6 and, once stopped, thereby locks wheel 20;

strip 10, strung by the escape wheel via head 2 changes into the S-shaped wavy position 53 in immediate proximity to energy pass CE2;

fork 6 remains immobile, resting on pin 41B, the winding of the bistable element has finished, lock is achieved;

balance 30 is mobile (it performs one vibration until the next phase T10), (with its impulse pin 35 in the 6 o'clock position).

In T10 balance 30 starts to return in the next vibration:

wheel 20 is immobile, with its tooth 21B resting on pallet stone 4;

head 2 is immobile resting, via its first arm 15A on second arm 17A of fork 6 and, once stopped, thereby locks wheel 20;

strip 10 is in S-shaped wavy position in shape 53 in immediate proximity to energy pass CE2;

fork 6 remains immobile, resting on pin 41B;

balance 30 pivots in the second direction, its impulse pin 35 in the 8 o'clock position rests on inner surface 81A of horn 8A, to start to release fork 6.

In T11, balance 30 releases fork 6, which in turn will release head 2;

wheel 20 is immobile, resting on pallet stone 4;

wheel 2 is immobile, resting on second arm 17A;

strip 10 is in the S-shaped wavy position in shape 53, ready to cross energy pass CE2; the bistable element becomes a drive element and takes up play once the energy pass is crossed;

fork 6 pivots in the first direction and reaches the position where it will release head 2;

balance 30 pivots in the second direction, with its impulse pin 35 in the 9 o'clock position resting on inner surface 81A of horn 8A, and releases fork 6.

In T12, strip 10 crosses energy pass CE2, and imparts an impulse in the second direction to balance 30, symmetrically to T4;

wheel 20 is free to move, still momentarily almost immobile due to its inertia;

head 2 is free to move, except for the connection to strip 10;

strip 10 crosses energy pass CE2, relaxes and changes into concave shape 52;

fork 6 pivots in the first direction, releases head 2, the inner surface 81B of its horn 8B drives impulse pin 35 in the second direction, for example clockwise, this is the impulse;

balance 30 pivots in the second direction, with its impulse pin 35 in the 9:30 position, driven by inner surface 81B of horn 8B.

In T13 the impulse ends, and fork 6 reaches a stopped position:

wheel 20 is free to move, still momentarily almost immobile due to its inertia;

head 2 is free to move;

strip 10 is in concave shape 52, in stable, low energy position PS1;

fork 6 pivots in the first direction, its horn 8B drives impulse pin 35 in the second direction, for example clockwise, and its stop surface 19A rests on pin 41A;

balance 30 pivots in the second direction, with its impulse pin 35 in the 10:30 position, driven by inner surface 81B of horn 8B.

In T14, in a similar manner to T6, balance 30 describes the supplementary arc, this time in the second direction:

wheel 20 is free to move, still momentarily almost immobile due to its inertia, and will start to pivot;

head 2 is free to move;

strip 10 is in concave shape 52, in stable, low energy position PS1;

fork 6 is immobile, resting on pin 41A;

balance 30 pivots in the second direction, with its impulse pin 35 in the 11 o'clock position.

In T15, in a similar manner to T7, wheel 20 passes pallet-stone 4;

wheel 20 pivots in the first direction;

head 2 pivots in the second direction, and pallet-stone 3 enters the trajectory of the teeth of wheel 20;

strip 10 is in concave shape 52, in stable, low energy position PS1;

fork 6 remains immobile, resting on pin 41A;

balance 30 is mobile (with its impulse pin 35 in the 11 o'clock position).

In T16, in a similar manner to T8, escape wheel 20 reaches pallet-stone 3:

wheel 20 pivots in the first direction, and a tooth 21C rests on pallet-stone 3;

head 2 is free to move and immobile;

strip 10 is in concave shape 52, in stable, low energy position PS1;

fork 6 remains immobile, resting on pin 41A;

balance 30 is mobile (with its impulse pin 35 in the 11 o'clock position).

Phase T17 ends the cycle, prior to returning to phase T1, in a similar manner to phase T9, the energy provided by wheel 20 enables strip 10 to be strung and recharged with energy; the strip approaches the next energy pass CE1:

wheel 20 pivots in the first direction, resting on pallet-stone 3 and pivots head 2;

head 2 pivots in the first direction, and strings strip 10;

strip 10 is a wavy Z-shape, referenced 54, approaching first energy pass CE1;

fork 6 remains immobile, resting on pin 41A;

balance 30 is mobile (with its impulse pin 35 in the 11 o'clock position).

The two phases of the "impulse of bistable strip 10 on balance 30" and the "winding of bistable strip 10 by escape wheel 20" are completely disassociated in the Figures to simplify the description of the successive phases of the cycle. In reality, the two phases overlap partly in time, but relatively little if the escape wheel inertia is high.

Typically:

the duration between phases 2 and 5 (impulse of the bistable element) is very short, provided by the speed of balance 30, close to 7 ms for an amplitude of 300° at 4 Hz and a lift angle of 50°;

the duration between phases 7 and 9 (winding bistable strip 10) may be long, up to around 120 ms if the escape wheel inertia is high (around one vibration).

For the energy transmitted to the balance always to be identical, it is preferable for bistable strip 10 to be strung slowly, and therefore for the inertia of the escape wheel (or of the rest of the gear train) to be high.

It is noted that one embodiment in FIGS. 30 and 31 with two superposed bistable strips 10S and 10J makes it possible, by adjusting the rigidity of return spring 104 between head 2 and fork 6, to obtain a similar distribution of energy, with two energy wells separated by a ridge.

Preferably, escapement mechanism 100 includes at least one main plate 40 carrying an escape wheel 20 and at least one balance 30 cooperating with one such pallet lever 1. Plate 40 comprises banking pins 41 (41A, 41B in the Figures) around fork 6 in proximity to a roller 31 of balance 30.

According to the invention, pallet lever 1 is connected to the plate:

on the one hand on first axis 5, either by a first pivot arbor 63 when pallet lever 1 is conventionally guided by a pivot and bearing, or by a first fixed connection 65 when pallet lever includes a flexible guide member with a first flexible pivot 61, and on the other hand on second axis 9, either by a second pivot arbor 64 when pallet lever 1 is conventionally guided by a pivot and bearing, or by a second fixed connection 66 when pallet lever 1 includes a flexible guide member with a second flexible pivot 62.

Plate 40 includes:

on the one hand, a first jewel 42 or a first arbor 43 or a first flexible guide member in a fixed position for pivotal guiding of head 2;

and on the other hand, a second jewel 44 or a second arbor 45 or a second flexible guide member for pivotal guiding of fork 6.

Figure 35:
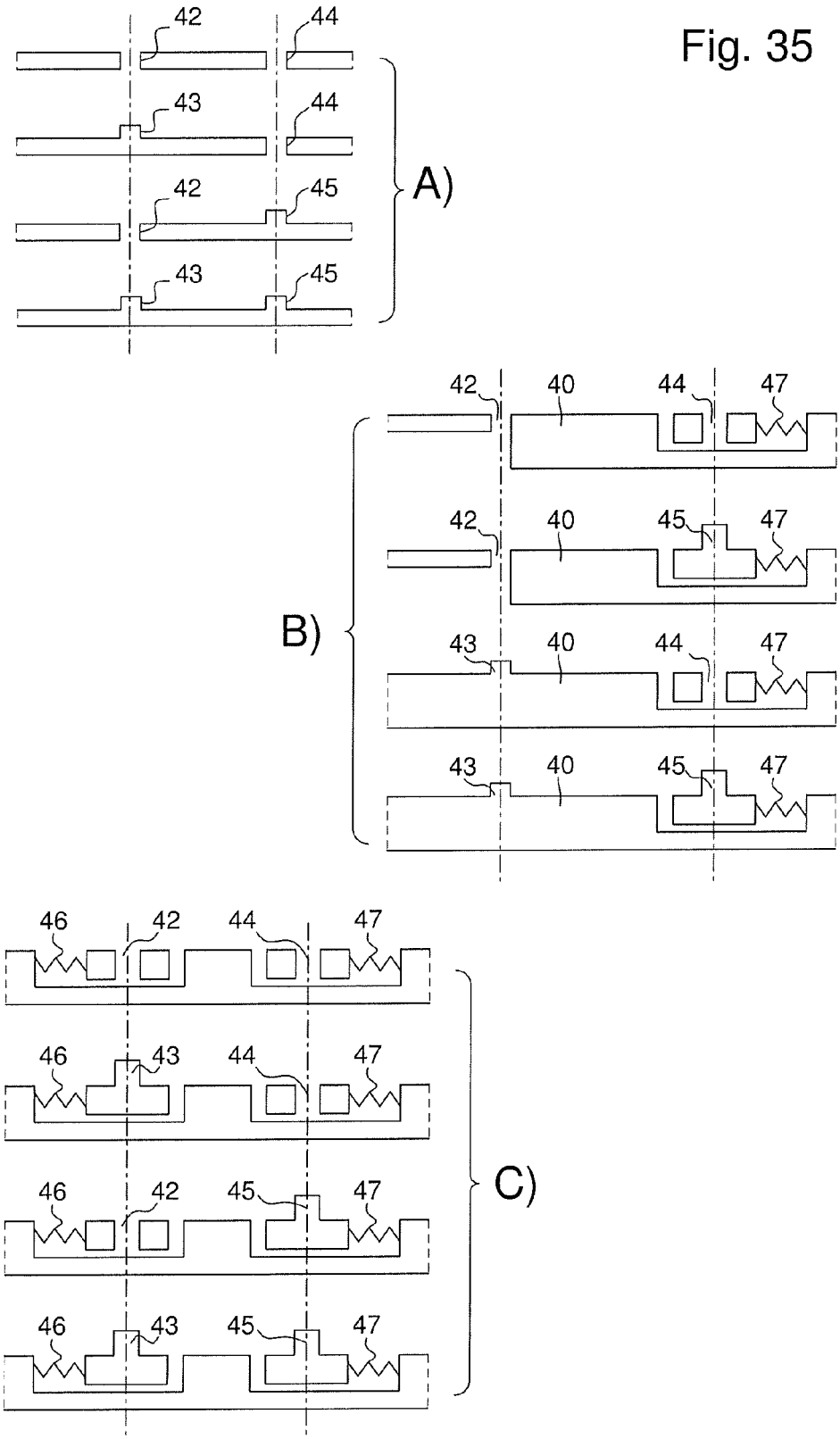
FIG. 35 illustrates a cross-section of different variants of the arrangement of the main plate receiving the pallet lever according to the invention.

As seen in FIG. 35, in a first variant A, the second jewel 44 or the second arbor 45 is at a fixed distance, and in a fixed position in a particular embodiment, relative to first jewel 42 or to first arbor 43.

In a second variant B, the second jewel 44 or the second arbor 45 is mobile, notable guided in translation in a particular embodiment, in a variable position relative to plate 40, and is subjected to the action of second elastic return means 47. Naturally, the reverse configuration is also possible wherein first jewel 42 or first arbor 43 is mobile in this manner. Naturally, it is possible to produce a variant where the mobility of second jewel 44 or second arbor 45 is not in a translational motion, but for example a pivotal motion, or any other motion.

In a third variant C, plate 40 includes, on the one hand, a first jewel 42 or a first arbor 43 which is mobile, particularly guided in translation in a particular embodiment, in a variable position relative to plate 40 and is subjected to the action of first elastic return means 46 for pivotally guiding head 2 and, on the other hand, a second jewel 44 or a second arbor 45 which is mobile, particularly guided in translation in a particular embodiment, in a variable position relative to plate 40 and is subjected to the action of second elastic return means 47 for pivotally guiding fork 6. Here too, the reverse configuration is possible. Naturally, it is possible to produce a variant where the mobility of first jewel 42 or first arbor 43 is not in a translational motion, but for example a pivotal motion, or any other motion.

Figure 36:
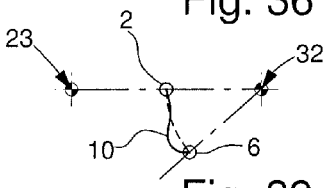
FIG. 36 illustrates a configuration wherein the fork is movable outside the alignment of the escape wheel-balance.

Preferably, in these different variants, the pivot axis 23 of escape wheel 20, pivot axis 32 of balance 30, first jewel 42 or respectively first arbor 43, second jewel 44 or respectively second arbor 45 are aligned. FIG. 36 illustrates another configuration wherein fork 6 is mobile outside the alignment of the escape wheel-balance, and wherein flexible strip 10 is deformed about a mean position which is, for example and in a non-limiting manner, a chord or an arc of a circle centred on the balance staff; this configuration makes it possible to modify an existing movement including conventional aligned bores, the axis usually used for a Swiss lever becoming axis 5 of head 2.

In a particular embodiment of the invention, bistable pallet lever 1 is pre-assembled in a cassette, and flexible strip 10 is already prestressed in the cassette, so that pallet lever 1 exhibits this exact bistable behaviour. The cassette includes a means of centring and/or securing to a plate. Advantageously, the cassette includes a centring means which is arranged to cooperate with the pivot usually provided for the Swiss lever in an existing movement. Depending on the case, the cassette still pivots about the pivot, or is immobilised in position relative to the plate carrying the pivot. This assembly in a cassette has the advantage of no longer requiring a bridge above the pallet lever. The cassette may also be provided with a micrometric position adjustment system. The cassette may also integrate a suspended shock resistant device.

Any means of achieving prestress in a precise manner is to produce an escape mechanism 100 including one or more sacrificial parts: pre-assembly is performed with these sacrificial elements intact, then, once pre-assembly is complete, the sacrificial elements are broken, releasing pre-calculated tensions to obtain the required prestress. This embodiment is suitable with a MEMs type embodiment made of silicon, silicon oxide or similar. The prestress may also be achieved with a silicon oxide growth making it possible to locally modify geometry in a controlled and extremely precise manner. Alternatively, stresses can be induced in the material.

Figure 38:
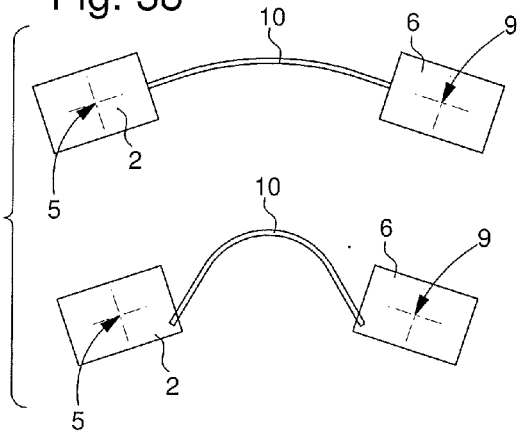
FIG. 38 illustrates two variant ways of embedding the flexible bistable strip in the pallet head and fork.
Figure 40:
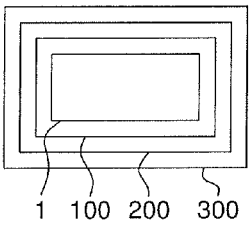
FIG. 40 shows block diagrams of a timepiece including a movement provided with an escapement having a pallet lever according to the invention.

FIG. 38 illustrates two variants for embedding the bistable flexible strip 10 in head 2 and fork 6 of the pallet lever, the first wherein strip 10 is substantially in the alignment of pivot axes 5 and 9, but wherein its ends are remote from the axes, and the second wherein assembly is asymmetrical, to facilitate one of the impulses, by creating a deeper energy well.

The invention also concerns a timepiece movement 200 including at least one escapement mechanism 100 of this type.

The invention also concerns a timepiece 300 including at least one timepiece movement 200 of this type, and/or at least one escape mechanism 100 of this type.

Naturally, flexible strip 10 is one non-limiting method among many for producing a bistable element between two halves of the pallet lever.

Likewise, the locking of head 2 of pallet lever 1 after the bistable element has been strung, and the release of head 2 at the end of the impulse imparted to balance 30 may be achieved according to other variants, without departing from the present invention.

Figure 25:
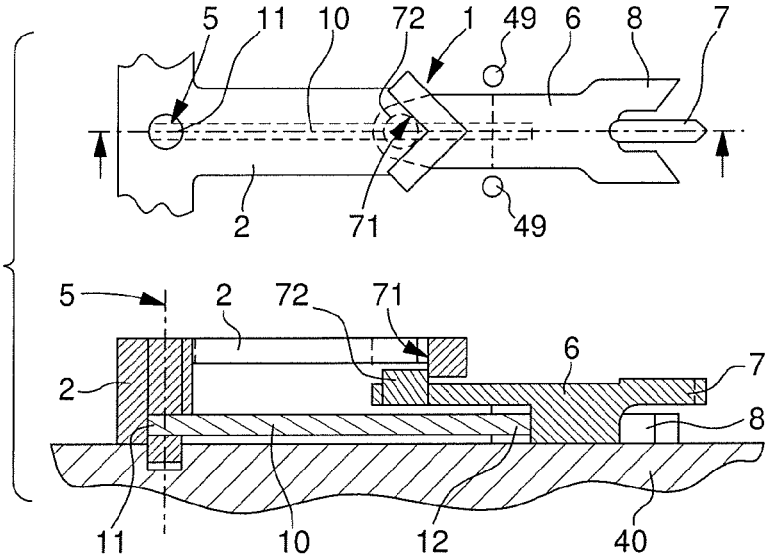
FIGS. 25 to 27 show schematic views of particular pallet lever embodiments according to the invention, wherein only the pallet head pivots about an axis, the fork being mounted at one end of a flexible bistable strip and limited in its travel so as to prestress the strip.
Figure 26:
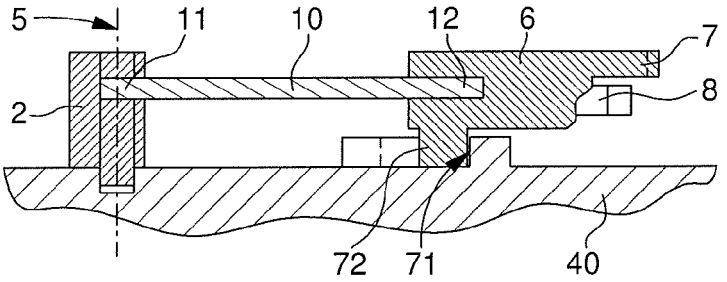

Yet another variant of the invention consists in mounting fork 6 directly attached to the bistable element, or bistable strip 10 depending on the case, and not pivoting fork 6 by allowing it any angular motion with any center, but by limiting the travel of fork 6 relative to first pivot axis 5 of head 2, by a banking element 71, so that the bistable element, or bistable strip 10, which is the only element able to pivot fork 6 relative to balance 30, remains prestressed throughout its entire operating range. As seen in FIGS. 25 and 26, this banking element 71 is integral with head 2 or integral with a plate 40 (projecting as in FIG. 26, or recessed) to which pallet lever 1 is fixed and cooperates with a complementary banking element 72 comprised in fork 6. Advantageously, element 71 is V-shaped, and element 72 is a pin or a trunnion. Pins 49 limit the motion of fork 6.

Figure 27:
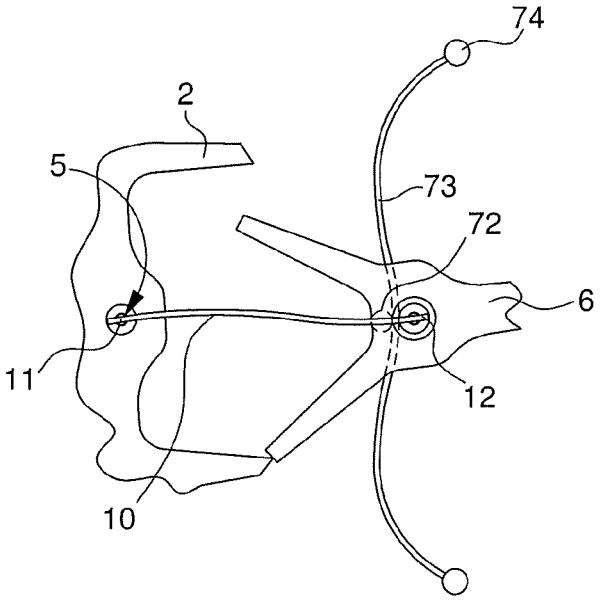
Figure 28:
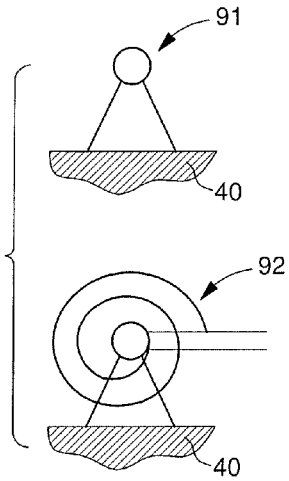
FIGS. 28 and 29 group together various pivot models that can be used particularly for the variants of FIGS. 23 and 24: a single conventional pivot, single flexible pivot, in FIG. 28 and a combination of a conventional pivot and a guide member with a certain rigidity, a combination of a flexible pivot and a guide member with a certain rigidity in FIG. 29.

FIG. 27 shows a variant wherein the prestress is achieved via a spring 73 secured to a fixed element 74 of plate 40, said spring 73 limiting the travel of fork 6 and prestressing strip 10.

Figure 23:
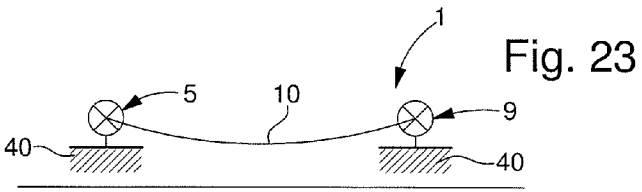
FIGS. 23 and 24 are schematic illustrations of two particular configurations of pivot axes relative to a main plate carrying the escapement mechanism.
Figure 24:
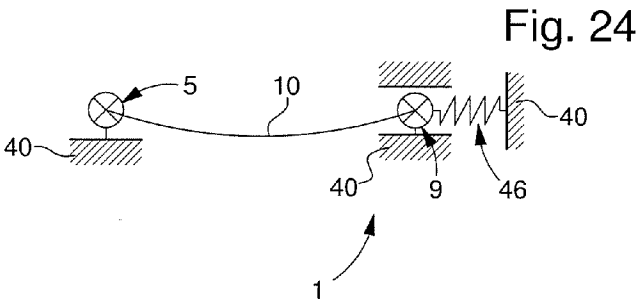
Figure 20:
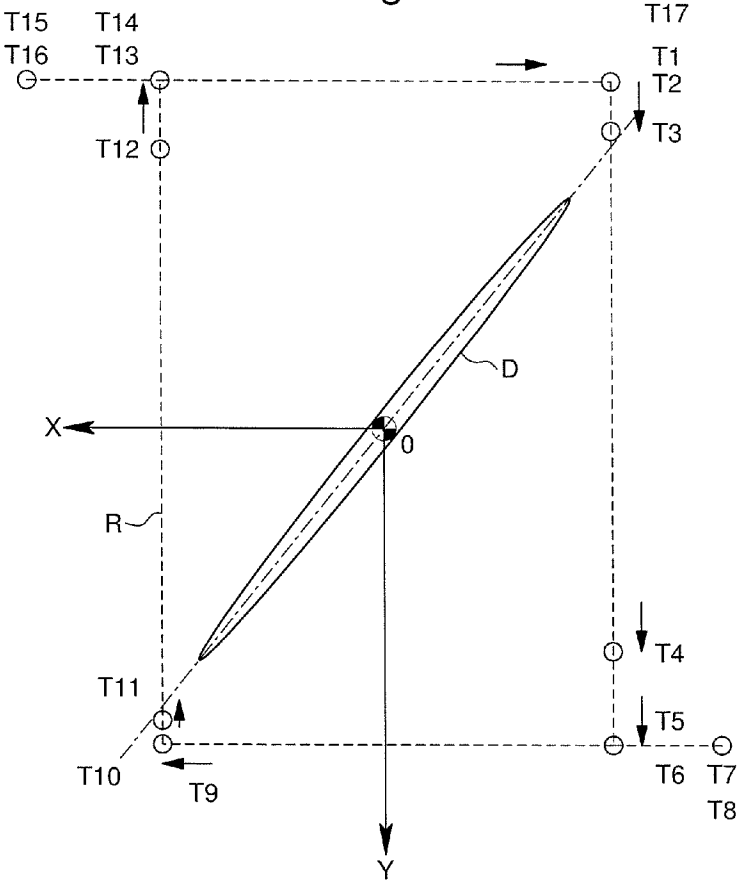
FIG. 20 shows the same rectangle, overlaid with the energy positions corresponding to times T1 to T17 of FIGS. 1 to 17.

FIGS. 23 and 24 illustrate two particular configurations of pivot axes relative to a main plate 40 carrying the escapement mechanism: in FIG. 23 a first pivot axis 5 and second pivot axis 9 in fixed positions relative to main plate 40, and in FIG. 24 with second axis 9 in a mobile position, in translation here, and combined with an elastic return means 46.

Figure 29:
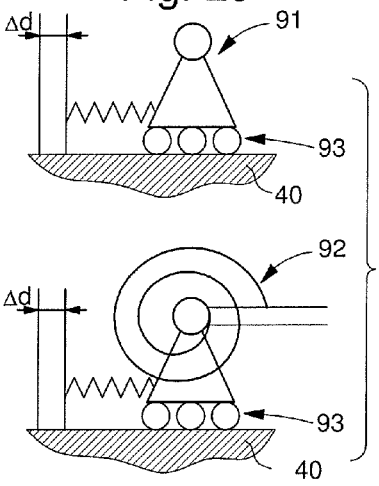

FIG. 29 groups together various pivot models that can be used particularly for these variants: a conventional single pivot 91, single flexible pivot 92, a combination of a conventional pivot 92 and a guide member 93 (particularly a linear guide member) with a certain rigidity, a combination of a flexible pivot 92 and a guide member (particularly a linear guide member) with a certain rigidity. In both of the latter cases, the displacement $\Delta d$ that induces prestress can be achieved with a screw, a cam, a wedge or similar element. This prestress acts, in particular, on the guide elements-spring 93 or flexible pivot 92. These different types of pivots may of course be combined with each other.

A flexible pallet lever according to the invention may be used in other types of escapement, particularly in that disclosed in EP Patent No 1967919 in the name of ETA, and in the prior art documents cited therein.

In short, the invention ensures very good control of the impulse, as a result of the use of a constant-force mechanism, including a bistable element which, alone, delivers energy to the balance, with regular intensity.

The energies involved are clearly disassociated in the different parts of the mechanism.

The support, or pivot or embedding points of flexible strip 10 at its ends 11, 101, 12, 102 are mobile relative to a plate or to a bridge of the mechanism in particular variants that are advantageous for prefabrication.

The mechanism of the invention makes it possible to achieve high operational security.

The invention easily lends itself to the incorporation of shock-absorber means, it is for example possible to incorporate shock-absorber buffers in the form of branches of first arms 15 of head 2, in proximity to the support or stop surfaces 16, or suchlike.

Disassociation of the components of the escapement mechanism according to the invention makes it possible, during the impulse, for only the fork to accelerate and not the entire mechanism.

The invention therefore makes it possible:

- to regulate the intensity of the impulse applied to the balance, the torque is constant;
- to reduce inertia in motion during the oscillation;
- to accomplish lock without any draw on the wheel.

The invention claimed is:

1. Pallet lever for a timepiece escapement, comprising:

a pallet head carrying at least one entry pallet and/or one exit pallet, and arranged to cooperate with an escape wheel;

a fork arranged to cooperate with a balance, wherein said fork includes a guard pin and horns for cooperation with said balance, and the angular position of said fork is variable relative to said head; and at least one flexible strip which provides the only direct, permanent, mechanical connection between said head and said fork, wherein:

the range of pivoting motion of said head and that of said fork are limited with respect to each other by stops, and said head includes at least a first arm including a first support and stop surface arranged to cooperate, in abutment or support, in certain relative positions of said head and of said fork, with a second support and stop surface in at least a second arm of said fork, and a repulsive interaction between said head and said fork is achieved in a magnetic and/or electrostatic manner.

2. Pallet lever according to claim 1, wherein the pallet lever includes, for attachment to a main plate, first securing and/or guide means carried by said head and second securing and/or guide means carried by said fork.

3. Pallet lever according to claim 1, wherein said pallet head is mobile relative to a first pivot axis or pivots about said first pivot axis and said fork is mobile relative to a second pivot axis or pivots about said second pivot axis which is distinct from said first pivot axis.

4. Pallet lever according to claim 3, wherein the pallet lever comprises a first flexible or virtual pivot and/or a second flexible or virtual pivot forming a flexible guide member respectively on said first axis and/or said second axis.

5. Pallet lever according to claim 3, wherein the pallet lever comprises a first flexible or virtual pivot and a second flexible or virtual pivot at the two ends of said at least one flexible strip, each forming a flexible guide member respectively on said first axis and said second axis.

6. Pallet lever according to claim 1, wherein the pallet lever is made in one-piece with said at least one flexible strip.

7. Pallet lever according to claim 6, the pallet lever is made of silicon or silicon oxide or metallic glass or "LIGA" nickel-phosphorus.

8. Pallet lever according to claim 1, wherein said pallet lever is pre-assembled in a cassette in which said at least one flexible strip is already placed, prestressed, so that said pallet lever is bistable, said cassette comprising a means for centring and/or securing on a plate.

9. Timepiece escapement mechanism, comprising:

at least one main plate carrying an escape wheel and a balance cooperating with a said pallet lever according to claim 1, wherein said head and said fork are assembled to said plate so that said at least one flexible strip is mounted prestressed buckled between said head at a first end and said fork at a second end, said pallet lever forming a bistable system comprising at least two stable states and two metastable states, and said two ends being, either each free to pivot in a housing that is free to move or fixed relative to said plate, or each embedded in a housing that is free to move relative to said plate, and at least one said housing then being subjected to a return force in the direction of the other said housing.

10. Mechanism according to claim 9, wherein said pallet lever performs a closed cycle during which said at least one flexible strip which is a bistable strip, successively occupies four main configurations:

after being recharged with energy by said escape wheel and during a transitional, high energy phase approaching a first energy pass, with a wavy Z-shaped profile;

after the energy available to said bistable strip is released, passing over said first energy pass, in the form of an impulse imparted to said balance in a first direction, said strip occupies a second, stable, low energy position, with a convex arc profile;

after being recharged with energy by said escape wheel and during a transitional, high energy phase approaching a second energy pass, with a wavy S-shaped profile;

after the energy available to said bistable strip is released, passing over said second energy pass, in the form of an impulse imparted to the balance in a second direction opposite to said first direction, said strip occupies a first, stable, low energy position, with a concave arc profile.

11. Mechanism according to claim 10, wherein the mechanism includes stops arranged to stop said bistable strip before said first or second energy pass, when said bistable strip is strung and recharged with energy.

12. Mechanism according to claim 11, wherein:

stops limiting the angular motion of said head, respectively of said fork are mobile and formed by surfaces of said fork, respectively of said head, and the pivoting motion of said head is limited by stops formed by two second arms comprised in said fork.

13. Mechanism according to claim 9, wherein said fork is mounted directly attached to said flexible bistable strip which alone ensures the pivoting of said fork relative to said balance, and in that the travel of said fork relative to a first pivot axis about which said head pivots is limited by a banking element integral with said head or said plate so that said bistable strip remains prestressed throughout the entire operating range thereof.

14. Mechanism according to claim 9, wherein said plate includes banking pins in proximity to a roller of said balance, said pallet lever is connected to said plate, on the one hand, on a first pivot axis about which said head pivots, either by a first pivot arbor when said head is guided in a conventional manner by a pivot and bearing, or by a first fixed connection when said head includes a flexible guide member with a first flexible pivot, and on the other hand, on a second axis about which said fork pivots, either by a second pivot arbor when said fork is guided in a conventional manner by a pivot and bearing, or by a second fixed connection when said fork includes a flexible guide member with a second flexible pivot.

15. Mechanism according to claim 14, wherein said plate includes, on the one hand, a first jewel or a first arbor in a fixed position for pivotally guiding said head or said fork, and on the other hand, a second jewel or a second arbor for pivotally guiding respectively said fork or said head.

16. Mechanism according to claim 15, wherein the pivot axis of said escape wheel, the pivot axis of said balance, said first jewel or respectively said first arbor, said second jewel or respectively said second arbor are aligned.

17. Mechanism according to claim 14, wherein said plate includes, on the one hand, a first jewel or a first arbor which is guided in a variable position relative to said plate and is subjected to the action of first elastic return means for pivotally guiding said head or said fork, and, on the other hand, a second jewel or a second arbor which is guided in translation in a variable position relative to said plate and is subjected to the action of second elastic return means for pivotally guiding said fork or said head respectively.

18. Timepiece including at least one escapement mechanism according to claim 9.

19. Mechanism according to claim 15, wherein said second jewel or said second arbor is either:

in a fixed position relative to said first jewel or to said first arbor, or guided in a variable position relative to said plate and is subjected to the action of second elastic return means.

* * * * *